US007055922B2

(12) United States Patent
Ikeda et al.

(10) Patent No.: US 7,055,922 B2
(45) Date of Patent: Jun. 6, 2006

(54) APPLYING VOLTAGES TO AN INK JET PRINTHEAD

(75) Inventors: Kouji Ikeda, Hyogo (JP); Koichi Baba, Osaka (JP); Masaharu Oyama, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/895,297

(22) Filed: Jul. 20, 2004

(65) Prior Publication Data

US 2005/0052492 A1 Mar. 10, 2005

Related U.S. Application Data

(62) Division of application No. 10/447,742, filed on May 29, 2003, now Pat. No. 6,783,212.

(30) Foreign Application Priority Data

Jun. 5, 2002 (JP) ..... 2002-164159
Jun. 5, 2002 (JP) ..... 2002-164178

(51) Int. Cl.
*B41J 29/38* (2006.01)

(52) U.S. Cl. ..... 347/10; 347/11

(58) Field of Classification Search ..... None
See application file for complete search history.

(56) References Cited

U.S. PATENT DOCUMENTS 6,042,210 A * 3/2000 Suematsu et al. ..... 347/12
6,070,959 A * 6/2000 Kanbayashi et al. ..... 347/11
2003/0151637 A1 8/2003 Nakamura et al.

FOREIGN PATENT DOCUMENTS

JP 2001162794 A 6/2001
WO WO 99/12739 3/1999

* cited by examiner

*Primary Examiner*—K. Feggins
*Assistant Examiner*—Julian D. Huffman
(74) *Attorney, Agent, or Firm*—Harness, Dickey & Pierce, P.L.C.

(57) ABSTRACT

An ink jet head includes: actuators each including a scanning electrode, a piezoelectric element and a recording electrode and arranged in a matrix pattern of n rows by m columns (where n and m are natural numbers equal to or greater than two) in terms of electrical circuit; and a driving circuit for supplying a scanning signal to the scanning electrodes for each column, while supplying a recording signal to each row of the recording electrodes in synchronization with the scanning signal. The actuators are geometrically arranged in n rows by m columns. A relay terminal, extending in a vertical direction, is provided in at least one inter-column space between vertical columns of the actuators for relaying signals from the driving circuit to the recording electrodes and the scanning electrodes. The recording electrodes and the scanning electrodes are connected to the relay terminal via lead wires extending in a horizontal direction.

8 Claims, 24 Drawing Sheets

FIG. 5A ON/OFF state of scanning electrode
| | | |
|---|---|---|
| First column | ON | OFF |
| Second column | OFF | ON |
FIG. 5B Recording signal
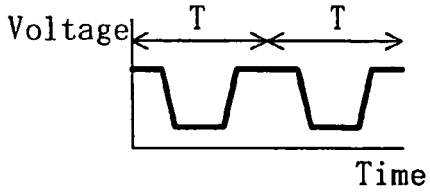
FIG. 5C Scanning signal
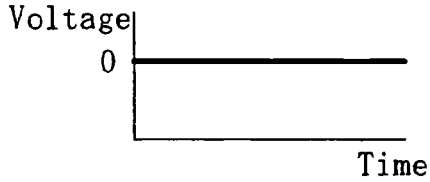
FIG. 5D Driving signal to actuator of first column
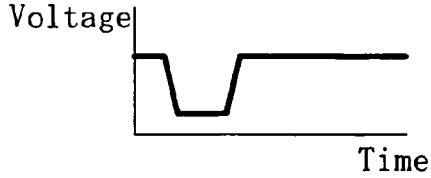
FIG. 5E Driving signal to actuator of second column
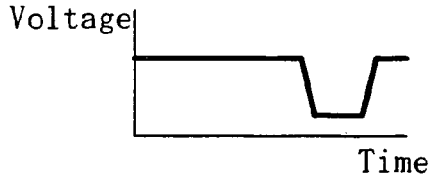

FIG. 8A
ON/OFF state of scanning electrode
| | | | | |
|---|---|---|---|---|
| First column | ON | OFF | ON | OFF |
| Second column | OFF | ON | OFF | ON |
| Third column | ON | OFF | ON | OFF |
| Fourth column | OFF | ON | OFF | ON |
FIG. 8B
Recording signal
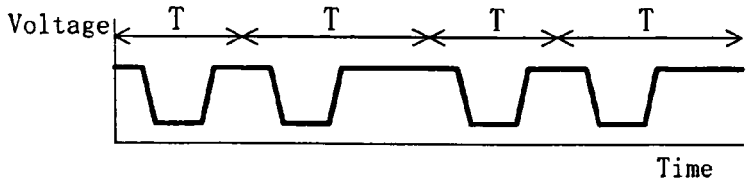
FIG. 8C
Scanning signal
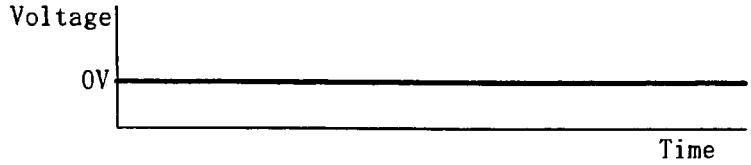
FIG. 8D
Driving signal to actuator of first column
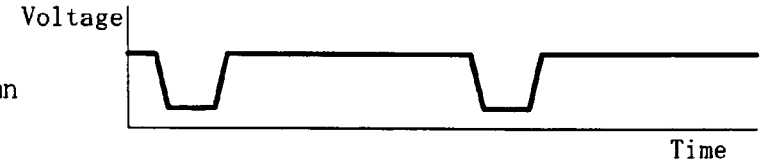
FIG. 8E
Driving signal to actuator of second column
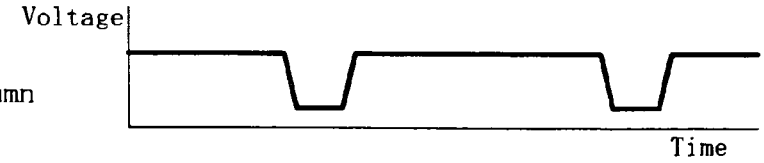
FIG. 8F
Driving signal to actuator of third column
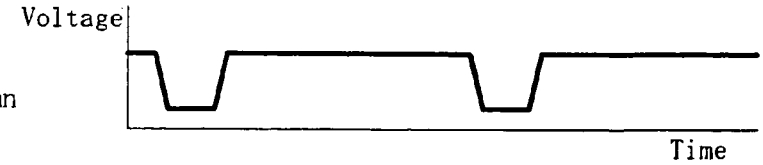
FIG. 8G
Driving signal to actuator of fourth column
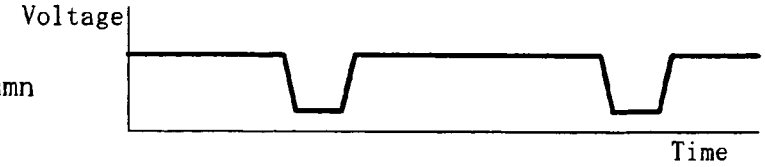

FIG. 13A
| ON/OFF state of scanning electrode | | | | | |
|---|---|---|---|---|---|
| | First column | ON | OFF | ON | OFF |
| | Second column | OFF | ON | OFF | ON |
FIG. 13B
Recording signal
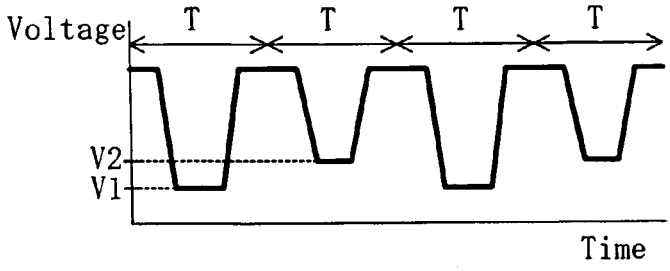
FIG. 13C
Scanning signal
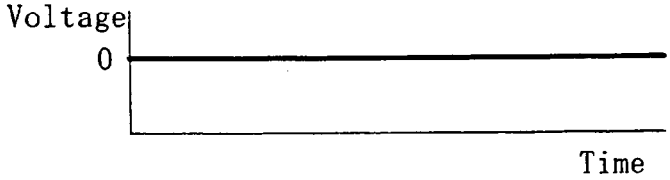
FIG. 13D
Driving signal to actuator of first column
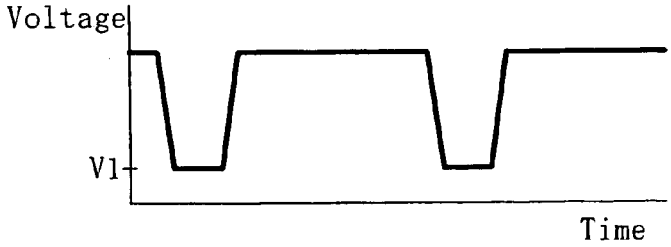
FIG. 13E
Driving signal to actuator of second column
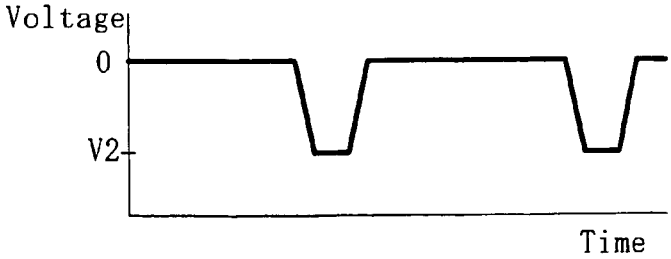

FIG. 14A
ON/OFF state of scanning electrode
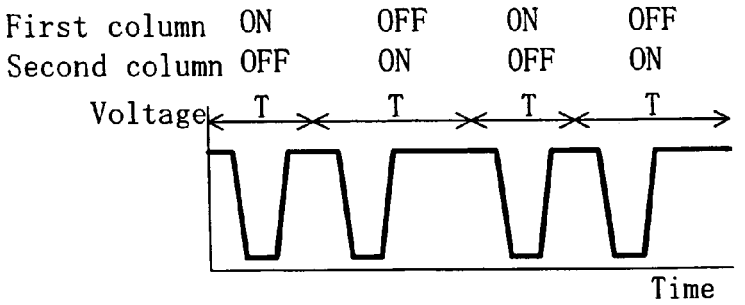
FIG. 14B
Recording signal
FIG. 14C
Scanning signal
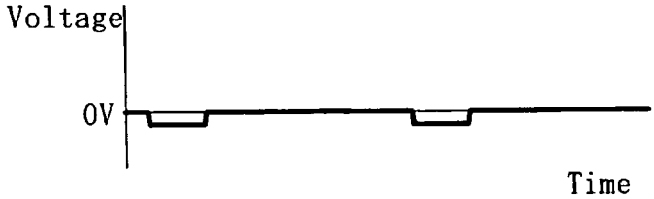
FIG. 14D
Driving signal to actuator of first column
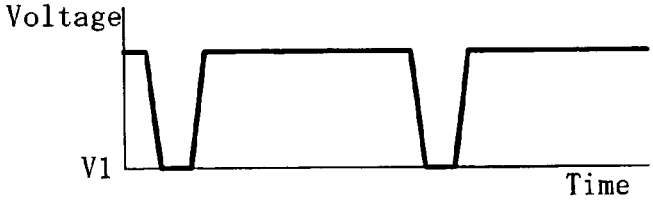
FIG. 14E
Driving signal to actuator of second column
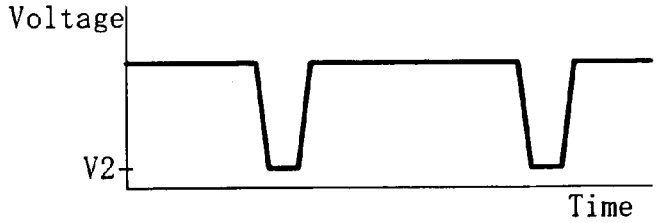

FIG. 16A

| ON/OFF state of scanning electrode | | | | | |
|---|---|---|---|---|---|
| | First column | ON | OFF | ON | OFF |
| | Second column | OFF | ON | OFF | ON |
| | Third column | ON | OFF | ON | OFF |
| | Fourth column | OFF | ON | OFF | ON |

FIG. 16B
Driving signal

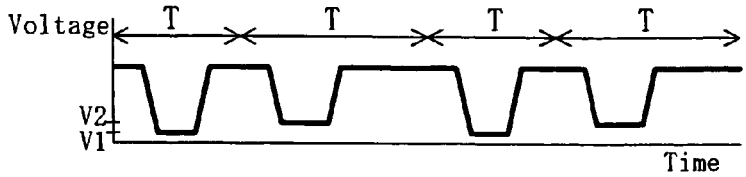

FIG. 16C
Scanning signal for first and second columns

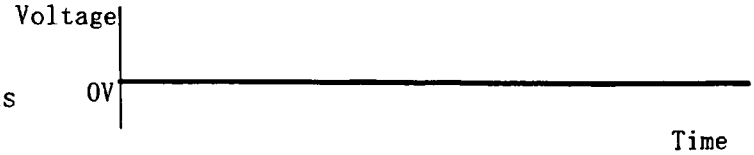

FIG. 16D
Scanning signal for third and fourth columns

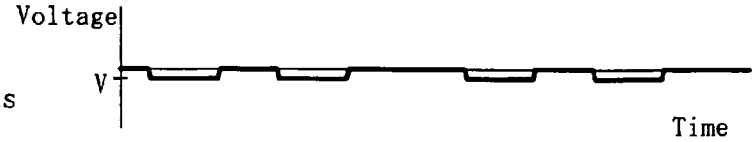

FIG. 16E
Driving signal to actuator of first column

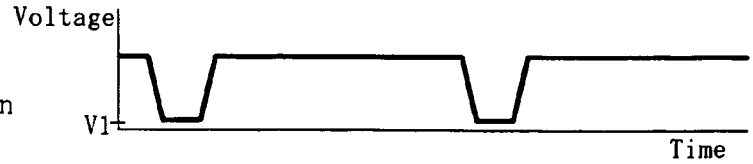

FIG. 16F
Driving signal to actuator of second column

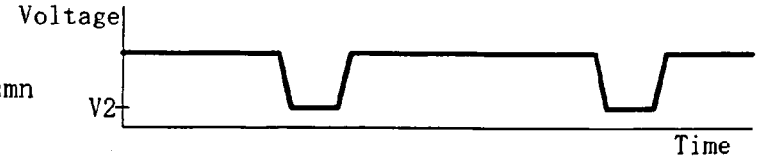

FIG. 16G
Driving signal to actuator of third column

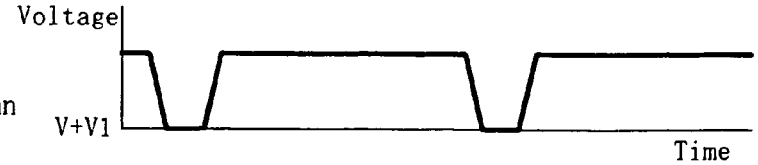

FIG. 16H
Driving signal to actuator of fourth column

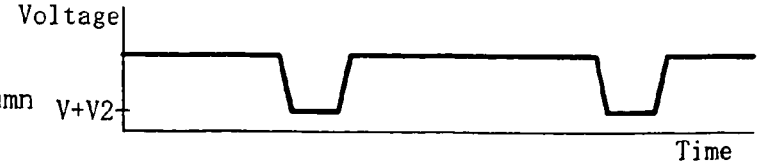

FIG. 18A
ON/OFF state of scanning electrode
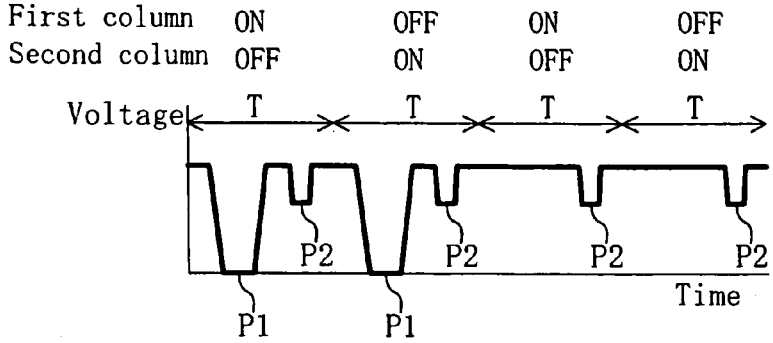
FIG. 18B
Recording signal
FIG. 18C
Driving signal to actuator of first column
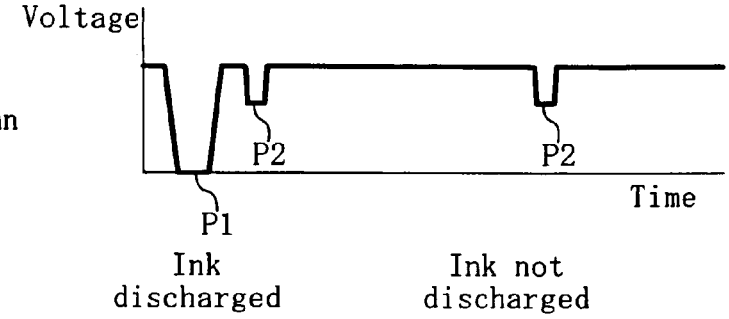
FIG. 18D
Driving signal to actuator of second column
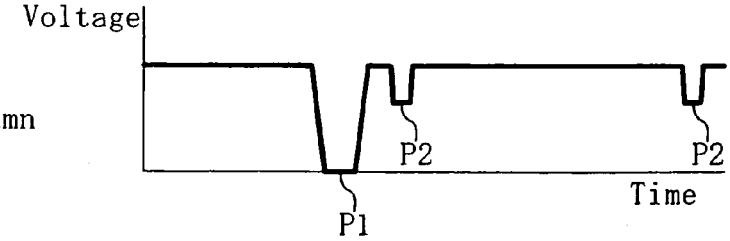

FIG. 19A
ON/OFF state of scanning electrode
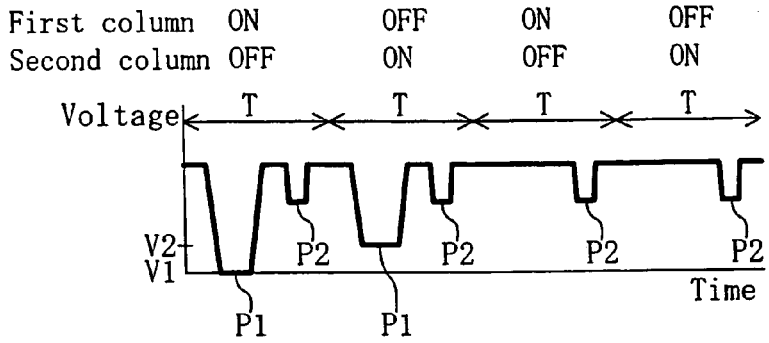
FIG. 19B
Recording signal
FIG. 19C
Driving signal to actuator of first column
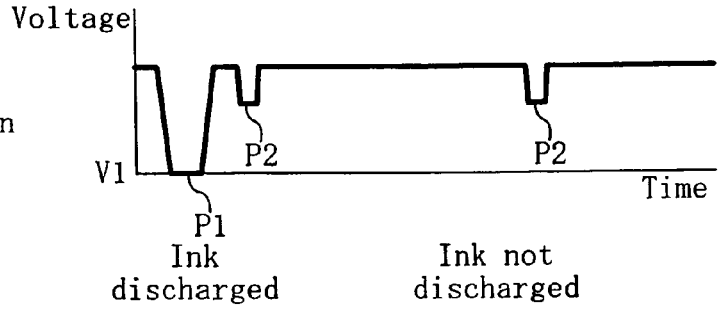
FIG. 19D
Driving signal to actuator of second column
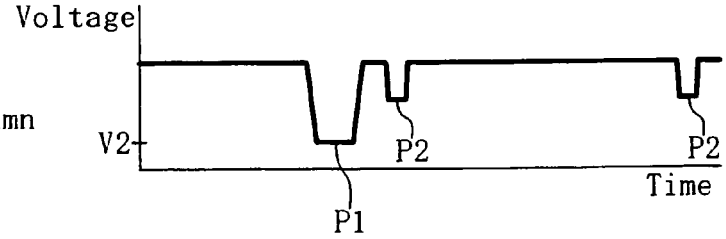

FIG. 20A
ON/OFF state of scanning electrode
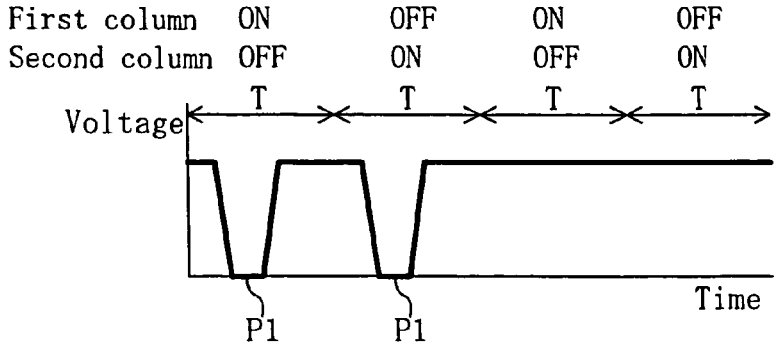
FIG. 20B
Recording signal
FIG. 20C
Scanning signal
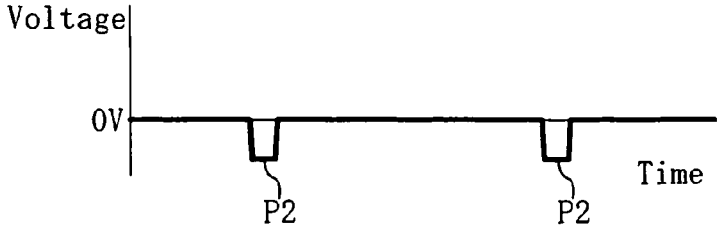
FIG. 20D
Driving signal to actuator of first column
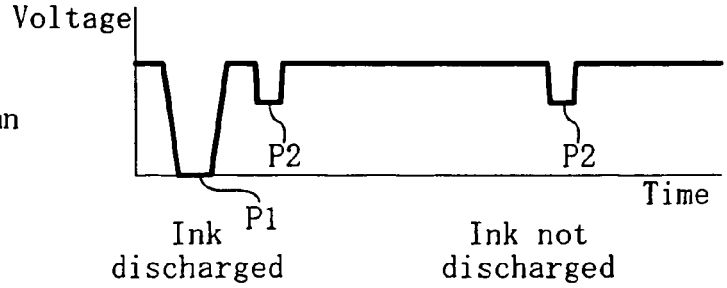
FIG. 20E
Driving signal to actuator of second column
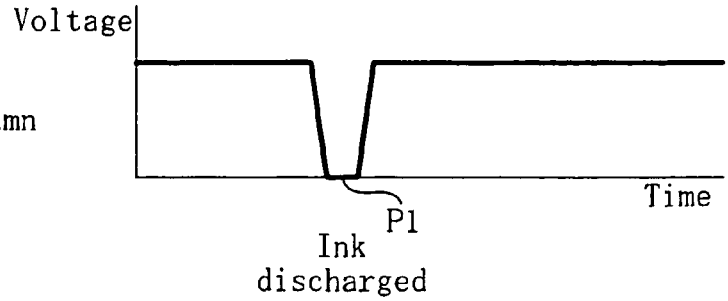

ON/OFF state of scanning electrode

Recording signal

Scanning signal

Driving signal to actuator of first column

Driving signal to actuator of second column

FIG. 22A
ON/OFF state of scanning electrode
| | | | | |
|---|---|---|---|---|
| First column | ON | OFF | ON | OFF |
| Second column | OFF | ON | OFF | ON |
FIG. 22B
Recording signal
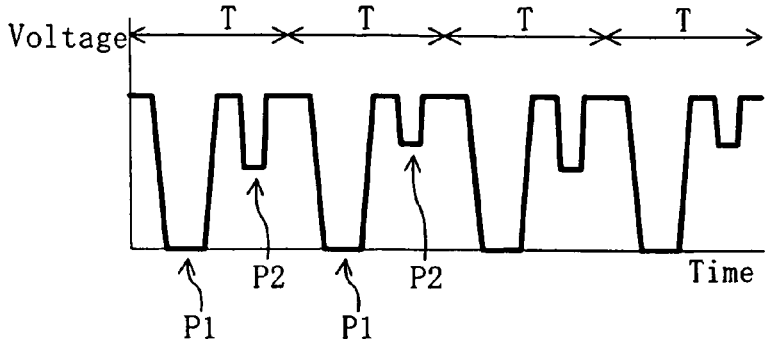
FIG. 22C
Driving signal to actuator of first column
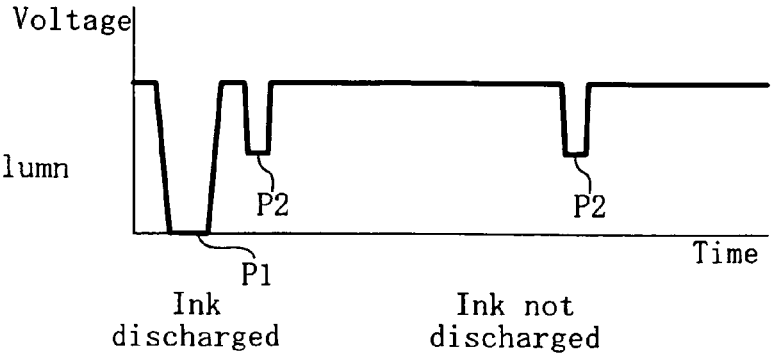
FIG. 22D
Driving signal to actuator of second column
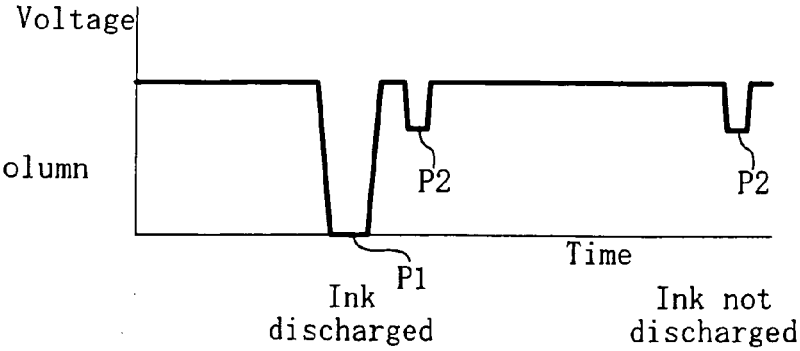

FIG. 23B Recording signal

ON/OFF state of scanning electrode

Recording signal

APPLYING VOLTAGES TO AN INK JET PRINTHEAD

CROSS-REFERENCE TO RELATED APPLICATIONS

This application is a divisional of U.S. patent application Ser. No. 10/447,742 filed on May 29, 2003 now U.S. Pat. No. 6,783,212. This application also claim the benefit of Japanese Patent Application Nos. 2002-164159 and 2002-164178 both filed Jun. 5, 2002. The disclosure(s) of the above application(s) are incorporated herein by reference.

FIELD OF THE INVENTION

The present invention relates to an ink jet head and an ink jet recording apparatus.

BACKGROUND OF THE INVENTION

An ink jet head using piezoelectric actuators including piezoelectric elements with electrodes provided on both sides thereof is known in the art, as disclosed in Japanese Laid-Open Patent Publication No. 2001-162794. An ink jet head of this type includes a plurality of nozzles, a plurality of pressure chambers associated with the respective nozzles, and a plurality of piezoelectric actuators associated with the respective pressure chambers. Typically, a single "common electrode" is provided on one side of the plurality of piezoelectric actuators so that the common electrode is shared by the piezoelectric actuators. On the other hand, "separate electrodes" are provided independently on the other side of the plurality of piezoelectric actuators. With the ink jet head as described above, a voltage is applied between a separate electrode and the common electrode so as to expand/contract a piezoelectric element, and a pressure is applied on the ink in a pressure chamber by the expansion/contraction, thereby discharging the ink through a nozzle.

An ink jet head is provided with a driving circuit for supplying a driving signal. The driving circuit of a conventional ink jet head has the same number of channels as the number of actuators in order to supply a driving signal individually to the separate electrode of each actuator. The driving circuit is designed so that a pulse signal is applied to an actuator that is to discharge ink while a pulse signal is not applied to an actuator that is not to discharge ink, thus turning the signal ON/OFF individually for each actuator.

With such an ink jet head, however, as the number of actuators increases, the number of channels of the driving circuit increases accordingly, whereby the cost for the driving circuit increases inevitably. With the recent increase in the number of nozzles provided in an ink jet head, the increase in the cost for the driving circuit is becoming non-negligible.

In view of this, an ink jet head employing a so-called "matrix driving" method has been suggested in the art, in which scanning electrodes and counter electrodes are arranged in a matrix pattern, as disclosed in Domestic Republication of PCT Publication WO99/12739. With an ink jet head employing a matrix driving method, the number of channels of the driving circuit can be reduced significantly, and thus the cost for the driving circuit can be reduced.

In an ink jet head employing a matrix driving method as described above, relay terminals connecting the driving circuit with the scanning electrodes, and relay terminals connecting the driving circuit with the counter electrodes, are localized at corners of the head assembly.

As a result, scanning electrode lead wires connecting the relay terminals with the scanning electrodes, and counter electrode lead wires connecting the relay terminals with the counter electrodes, are relatively long. Therefore, the lead wires have relatively high electric resistances.

Moreover, the scanning electrode lead wires and the counter electrode lead wires have different lengths for different scanning electrodes or different counter electrodes. Therefore, signals supplied to different electrodes vary slightly from one another, whereby different nozzles are likely to have varied levels of ink discharging performance. As a result, the recording precision is not sufficiently high. Moreover, while it is necessary, with a matrix driving method, that signals to be applied to the scanning electrodes (hereinafter referred to as "scanning signals") and signals to be applied to the counter electrode (hereinafter referred to as "recording signals") need to be precisely synchronized with each other, it is difficult to achieve precise synchronization if signals supplied to different electrodes vary from one another.

Some ink jet heads use a plurality of types of ink. For example, an ink jet head for forming a color image uses a plurality of colors of ink. In such an ink jet head, a plurality of actuators are provided to form a column of actuators for each color. With a conventional ink jet head of this type, the driving circuit supplies the same driving signal to actuators of the actuator columns for all colors.

However, properties of ink such as the viscosity vary among different types of ink. Therefore, even if the same driving signal is applied, the difference in the type of ink results in a difference in the ink discharging performance.

In view of this, in the prior art, types of ink are chosen, or the physical properties of different types of ink are adjusted, so that the ink discharging characteristics are made uniform among the different types of ink. However, this imposes a certain limitation on the types of ink that can be used.

Another way is to adjust a driving signal for each type of ink. However, with such an ink jet head, as disclosed in Japanese Laid-Open Patent Publication No. 2001-162794, the configuration of the driving circuit may become complicated, leading to other problems such as an increase in the cost for the driving circuit and a decrease in the reliability in controlling the ink discharge.

Note that these problems occur not only when a plurality of types of ink are used, but also when there are variations in the actuator characteristics or the pressure chamber size among different actuator columns.

SUMMARY OF THE INVENTION

The present invention has been made in view of the above. An object of the present invention is to shorten a lead wire connecting a relay terminal with an electrode. Another object of the present invention is to suppress the variations among signals supplied to different electrodes, thereby improving the ink discharging performance. Still another object of the present invention is to precisely synchronize the scanning signal with the recording signal. Yet another object of the present invention is to provide a technique that allows easy adjustment of a driving signal for each column without complicating the configuration of the driving circuit.

An ink jet head of the present invention includes: a head assembly provided with a plurality of nozzles and a plurality of pressure chambers storing ink therein and communicated respectively to the nozzles; actuators each associated with one of the pressure chambers and each including a piezoelectric element, a scanning electrode provided on one side of the piezoelectric element, and a recording electrode provided on the other side of the piezoelectric element, wherein the actuators are arranged in a matrix pattern of n rows by m columns (where n and m are natural numbers equal to or greater than two) in terms of electrical circuit, with the recording electrodes of each row being electrically connected to one another, and the scanning electrodes of each column being electrically connected to one another; and a driving circuit for supplying a scanning signal to the scanning electrodes for each column, while supplying a recording signal to each row of the recording electrodes in synchronization with the scanning signal, wherein: the actuators are geometrically arranged in n rows by m columns on the head assembly; a relay terminal, extending in a vertical direction, is provided in at least one inter-column space between vertical columns of the actuators on the head assembly for relaying signals from the driving circuit to the recording electrodes and the scanning electrodes; and the recording electrodes and the scanning electrodes are connected to the relay terminal via lead wires extending in a horizontal direction.

In this ink jet head, the relay terminal extends in the vertical direction, and the lead wires connecting the relay terminal with the recording electrodes and the scanning electrodes extend in the horizontal direction, whereby it is not necessary to extend the lead wires in a complicated pattern, e.g., a meandering pattern, and it is thus possible to reduce the length of the lead wires. Moreover, since the relay terminal is provided in an inter-column space between actuator columns, the distance between the relay terminal and the actuators is reduced, whereby the length of the lead wires can be reduced accordingly.

It is preferred that m is an even number; and the relay terminal is provided in a central inter-column space between the actuators.

This allows for a further reduction of the length of the lead wires. Moreover, the arrangement pattern of the lead wires is left-right symmetrical with respect to the relay terminal, thereby reducing variations between signals supplied to the electrodes of the left-side actuators and those supplied to the electrodes of the right-side actuators, and thus suppressing variations in the ink discharging performance. Moreover, the scanning signal and the recording signal can be synchronized with each other more precisely.

Another ink jet head of the present invention includes: the head assembly; the actuators; and the driving circuit, wherein: a first relay terminal and a second relay terminal, both extending in a vertical direction, for relaying signals from the driving circuit to the recording electrodes and the scanning electrodes are provided on a left side and a right side, respectively, of an area on the head assembly where the actuators are arranged; and the recording electrodes and the scanning electrodes are connected to the relay terminals via lead wires extending in a horizontal direction.

Also in this ink jet head, the relay terminals extend in the vertical direction, and the lead wires connecting the relay terminals with the recording electrodes and the scanning electrodes extend in the horizontal direction, whereby it is not necessary to extend the lead wires in a complicated pattern, e.g., a meandering pattern, and it is thus possible to reduce the length of the lead wires. Moreover, the relay terminal is divided into two relay terminals, which are provided on the left side and the right side of the area where the actuators are arranged, whereby the distance between each relay terminal and the actuators associated with the relay terminal is reduced, whereby the length of the lead wires can be reduced accordingly.

It is preferred that m is an even number; the recording electrodes and the scanning electrodes of the actuators on the left side are connected to the first relay terminal; and the recording electrodes and the scanning electrodes of the actuators on the right side are connected to the second relay terminal.

This allows for a further reduction of the length of the lead wires. Moreover, the arrangement pattern of the lead wires is left-right symmetrical, thereby reducing variations between signals supplied to the electrodes of the left-side actuators and those supplied to the electrodes of the right-side actuators, and thus suppressing variations in the ink discharging performance. Moreover, the scanning signal and the recording signal can be synchronized with each other more precisely.

It is preferred that a difference in time constant between actuators belonging to different vertical columns is set to be 0.1 μs or less.

In one embodiment, an actuator that is geometrically located along a $p^{th}$ row and a $q^{th}$ column (where p is a natural number of 1 to n, and q is a natural number of 1 to m) is located along the $p^{th}$ row and the $q^{th}$ column in terms of electrical circuit.

In this ink jet head, the arrangement pattern of the actuators in terms of electrical circuit coincides with the geometric arrangement pattern thereof.

In one embodiment, actuators that are geometrically adjacent to each other in the vertical direction belong to different columns in terms of electrical circuit.

The scanning signal is supplied separately for each column, and the scanning signal will not be supplied simultaneously to actuators belonging to different columns. Therefore, with this ink jet head, actuators that are geometrically adjacent to each other in the vertical direction will not be driven at the same time. Thus, it is possible to prevent crosstalk between actuators that are adjacent to each other in the vertical direction, thereby improving the ink discharging performance.

In one embodiment, actuators that are geometrically adjacent to each other in the horizontal direction belong to different columns in terms of electrical circuit.

In this way, it is possible to prevent crosstalk between actuators that are adjacent to each other in the horizontal direction, thereby improving the ink discharging performance.

In one embodiment, actuators that are geometrically adjacent to each other in the vertical direction and those that are geometrically adjacent to each other in the horizontal direction belong to different columns in terms of electrical circuit.

In this way, it is possible to prevent crosstalk between actuators that are adjacent to each other in the vertical direction and those that are adjacent to each other in the horizontal direction, thereby improving ink discharging performance.

In one embodiment, a driving signal obtained by combining the recording: signal with the scanning signal varies among at least two or more actuator columns.

In this way, the voltage of the driving signal can be adjusted for each column, and it is possible to control the ink discharge for each column according to the actuator characteristics, the ink characteristics, etc., of the column.

In one embodiment, a voltage of the scanning signal is equal among different actuator columns; and a voltage of the recording signal varies among at least two or more actuator columns.

In one embodiment, a voltage of the recording signal is equal among different actuator columns; and a voltage of the scanning signal varies among at least two or more actuator columns.

In one embodiment, a voltage of the scanning signal varies among at least two or more actuator columns; and a voltage of the recording signal varies among at least two or more actuator columns.

In one embodiment, when ink is to be discharged, a driving signal obtained by combining the recording signal with the scanning signal includes an ink discharging pulse signal for driving an actuator so as to discharge ink and an auxiliary pulse signal for driving an actuator to such a degree that ink is not discharged, and when ink is not to be discharged, the driving signal includes the auxiliary pulse signal for driving an actuator to such a degree that ink is not discharged.

Thus, by driving an actuator to such a degree that ink is not discharged by using the auxiliary pulse signal, it is possible to, for example, suppress the residual vibration after ink is discharged, or suppress an increase in the viscosity of ink in the nozzle.

In one embodiment, a voltage of the auxiliary pulse signal varies among at least two or more actuator columns.

In this way, the voltage of the auxiliary pulse signal can be adjusted for each actuator column, and it is possible to supply the auxiliary pulse signal for each column according to the actuator characteristics, the ink characteristics, etc., of the column.

In one embodiment, the ink discharging pulse signal is included in the recording signal; and the auxiliary pulse signal is included in the scanning signal.

In this way, with respect to the production of the driving signal, the recording signal and the scanning signal can be simplified.

It is preferred that the driving circuit supplies, prior to a recording operation, a preliminary pulse signal for driving an actuator to such a degree that ink is not discharged to all actuators.

Before a recording operation, ink in a nozzle may be dry and have an increased viscosity. If the viscosity of ink in a nozzle is high, a false discharge of ink may occur through the nozzle. However, with this ink jet head, the preliminary pulse signal is supplied prior to the recording operation, thereby stirring ink in the nozzle. Therefore, a portion of ink of a high viscosity near the exit of a nozzle is mixed with a portion of ink of a low viscosity inside the nozzle, thereby suppressing the increase in the viscosity of ink. Thus, it is possible to prevent the false discharge of ink at the start of a recording operation.

In one embodiment, when a small ink droplet is to be discharged, a driving signal obtained by combining the recording signal with the scanning signal includes a first pulse signal, and when a large ink droplet is to be discharged, the driving signal includes two or more pulse signals produced after the first pulse signal.

In this way, a small ink droplet is discharged when a single pulse signal is supplied, and a large ink droplet is discharged when a plurality of pulse signals are supplied. A large ink droplet is discharged by a so-called "multi-pulse" driving method. This allows for a multi-gray-level recording operation. In a case where a small ink droplet and a large ink droplet are discharged successively, the first pulse signal for discharging a small ink droplet is supplied after the supply of a plurality of pulse signals for discharging a large ink droplet in the preceding cycle. If the plurality of pulse signals and the first pulse signal are discharged successively, the discharge of a small ink droplet is likely to be influenced by the residual vibration of the actuator from the discharge of a large ink droplet. However, with this ink jet head, the scanning signal is supplied separately for each column, whereby there is a certain time interval corresponding to the number of actuator columns between the discharge of a large ink droplet and the discharge of a small ink droplet. Therefore, the discharge of a small ink droplet after the discharge of a large ink droplet is less likely to be influenced by the residual vibration and can be done stably.

In one embodiment, the n rows by m columns of actuators are geometrically arranged on the head assembly so that at least actuators of vertical columns that are adjacent to each other, among m vertical columns each including n actuators arranged in the vertical direction, are shifted from each other with respect to the vertical direction.

In one embodiment, the actuators are geometrically arranged in a staggered pattern on the head assembly.

Still another ink jet head of the present invention includes: the head assembly; the actuators; the driving circuit, wherein a voltage of a driving signal obtained by combining the scanning signal with the recording signal varies among at least two or more actuator columns.

In this way, the driving signal is obtained by combining the scanning signal with the recording signal, whereby it is no longer necessary to produce a plurality of driving signals for different actuators. Therefore, without complicating the driving circuit, the voltage of the driving signal can be adjusted for each actuator column, and it is possible to easily supply the driving signal for each column according to the actuator characteristics, the ink characteristics, etc., of the column.

In one embodiment, a voltage of the scanning signal is equal among different actuator columns; and a voltage of the recording signal varies among at least two or more actuator columns.

In one embodiment, a voltage of the recording signal is equal among different actuator columns; and a voltage of the scanning signal varies among at least two or more actuator columns.

In one embodiment, a voltage of the scanning signal varies among at least two or more actuator columns; and a voltage of the recording signal varies among at least two or more actuator columns.

In one embodiment, when ink is to be discharged, the driving signal includes an ink discharging pulse signal for driving an actuator so as to discharge ink and an auxiliary pulse signal for driving an actuator to such a degree that ink is not discharged, and when ink is not to be discharged, the driving signal includes the auxiliary pulse signal for driving an actuator to such a degree that ink is not discharged; and a voltage of the ink discharging pulse signal varies among at least two or more actuator columns.

Thus, by driving an actuator to such a degree that ink is not discharged by using the auxiliary pulse signal, it is possible to, for example, suppress the residual vibration after ink is discharged, or suppress an increase in the viscosity of ink in the nozzle. By adjusting the voltage of the ink discharging pulse signal for each actuator column, it is possible to discharge ink for each column according to the actuator characteristics, the ink characteristics, etc., of the column.

In one embodiment, when ink is to be discharged, the driving signal includes an ink discharging pulse signal for driving an actuator so as to discharge ink and an auxiliary pulse signal for driving an actuator to such a degree that ink is not discharged, and when ink is not to be discharged, the driving signal includes the auxiliary pulse signal for driving an actuator to such a degree that ink is not discharged; and a voltage of the auxiliary pulse signal varies among at least two or more actuator columns.

Thus, the auxiliary pulse signal provides auxiliary driving of an actuator such that ink is not discharged. As a result, it is possible to, for example, suppress the residual vibration after ink is discharged, or suppress an increase in the viscosity of ink in the nozzle. By adjusting the voltage of the auxiliary pulse signal for each actuator column, it is possible to provide auxiliary driving for each column according to the actuator characteristics, the ink characteristics, etc., of the column.

In one embodiment, the ink discharging pulse signal is included in the recording signal; and the auxiliary pulse signal is included in the scanning signal.

In this way, with respect to the production of the driving signal, the recording signal and the scanning signal can be simplified.

In one embodiment, when a small ink droplet is to be discharged, the ink discharging pulse signal includes a first pulse signal, and when a large ink droplet is to be discharged, the ink discharging pulse signal includes two or more following pulse signals produced after the first pulse signal.

In one embodiment, the driving circuit supplies, prior to a recording operation, a preliminary pulse signal for driving an actuator to such a degree that ink is not discharged to all actuators.

An ink jet recording apparatus of the present invention includes: any of the ink jet heads set forth above; and movement means for relatively moving the ink jet head and a recording medium with respect to each other.

BRIEF DESCRIPTION OF THE DRAWINGS

FIG. 5A to FIG. 5E are waveform diagrams illustrating signals used in Embodiment 1.

FIG. 8A to FIG. 8G are waveform diagrams illustrating signals used in Embodiment 2.

FIG. 13A to FIG. 13E are waveform diagrams illustrating signals used in Embodiment 5.

FIG. 14A to FIG. 14E are waveform diagrams illustrating signals used in Embodiment 5.

FIG. 16A to FIG. 16H are waveform diagrams illustrating signals used in Embodiment 6.

FIG. 18A to FIG. 18D are waveform diagrams illustrating signals used in Embodiment 7.

FIG. 19A to FIG. 19D are waveform diagrams illustrating signals used in Embodiment 7.

FIG. 20A to FIG. 20E are waveform diagrams illustrating signals used in Embodiment 7.

FIG. 22A to FIG. 22D are waveform diagrams illustrating signals used in Embodiment 7.

FIG. 23A and FIG. 23B are waveform diagrams illustrating signals used in Embodiment 7.

DESCRIPTION OF THE PREFERRED EMBODIMENTS

Embodiments of the present invention will now be described with reference to the drawings.

EMBODIMENT 1

Figure 1:
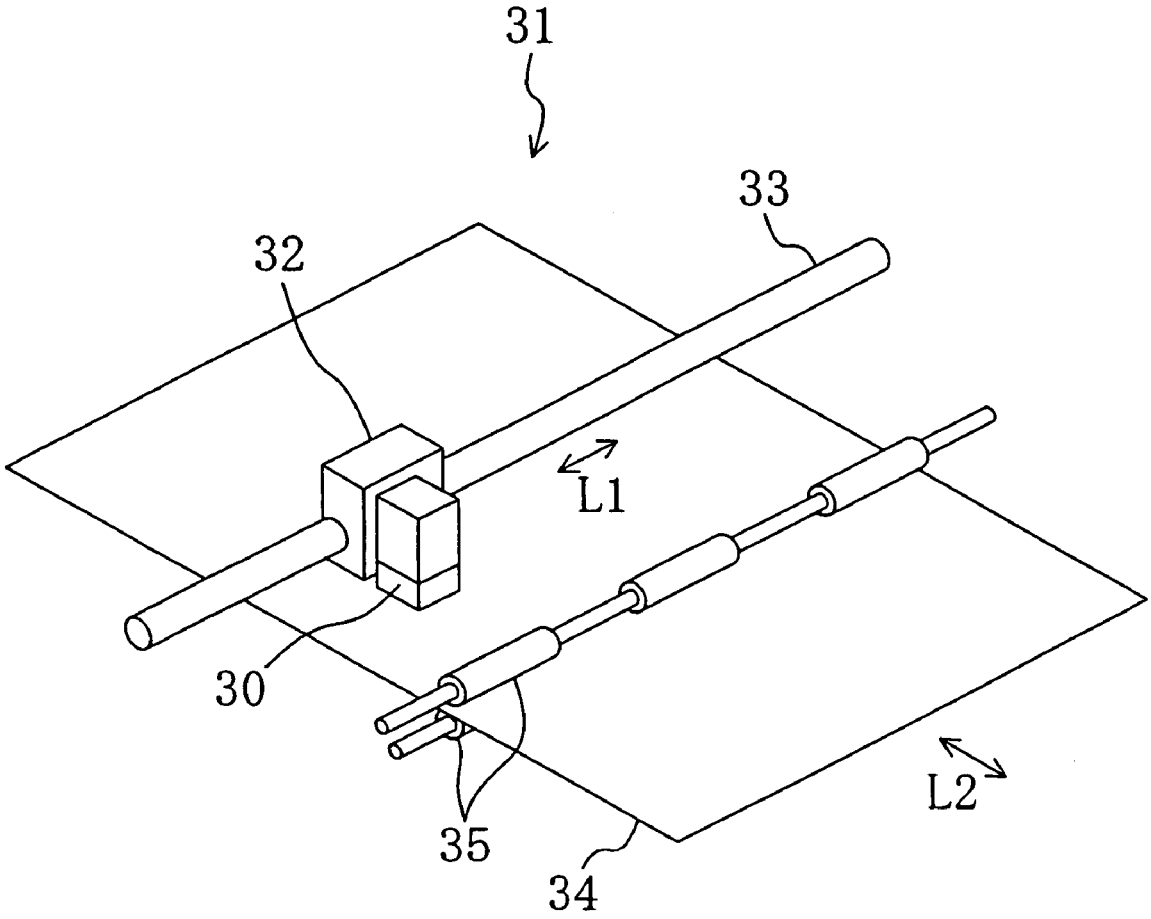
FIG. 1 is a perspective view illustrating an important part of an ink jet printer.

FIG. 1 schematically illustrates an important part of an ink jet printer 31 including an ink jet head 30 according to the present embodiment. The ink jet head 30 is attached to a carriage 32 that is provided with a carriage motor (not shown). The carriage 32 is reciprocated by the carriage motor in the direction labeled "L1" in the figure while being guided by a carriage shaft 33 extending in the direction L1. Thus, the ink jet head 30 is reciprocated in the direction L1.

Recording paper 34 is sandwiched between two carrier rollers 35, which are rotated by a carrier motor (not shown), and is carried by the carrier motor and the carrier rollers 35 in the direction labeled "L2" in the figure, which is perpendicular to the direction L1.

The carriage 32 and the carriage motor together form movement means for the direction L1. The carrier rollers 35 and the carrier motor together form movement means for the direction L2.

Note however that the recording apparatus of the present invention is not limited to the printer 31 as described above, but the present invention may alternatively be applied to other types of printers. Moreover, the recording apparatus of the present invention is not limited to a printer, but may alternatively be any other type of recording apparatus having an ink jet head therein, such as a copier or a facsimile. The recording medium is not limited to the recording paper 34, but may alternatively be any other type of medium such as a plastic film.

Figure 2:
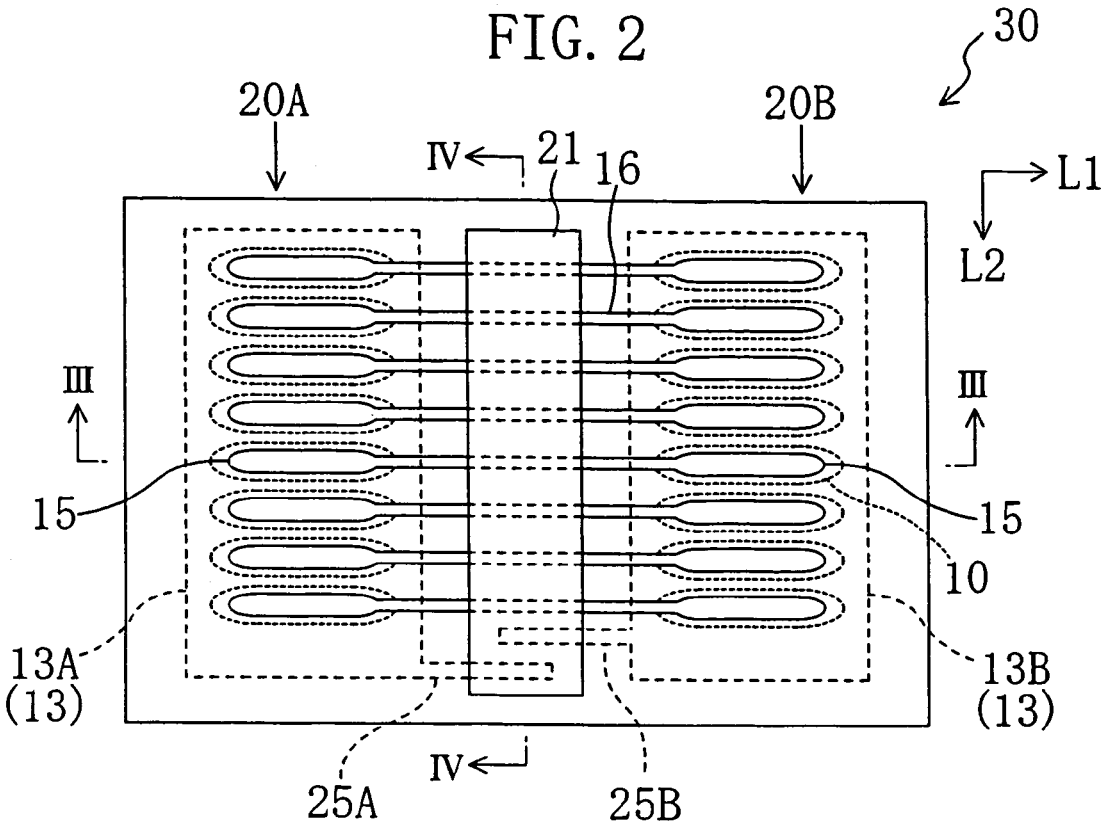
FIG. 2 is a plan view illustrating an ink jet head according to Embodiment 1.
Figure 3:
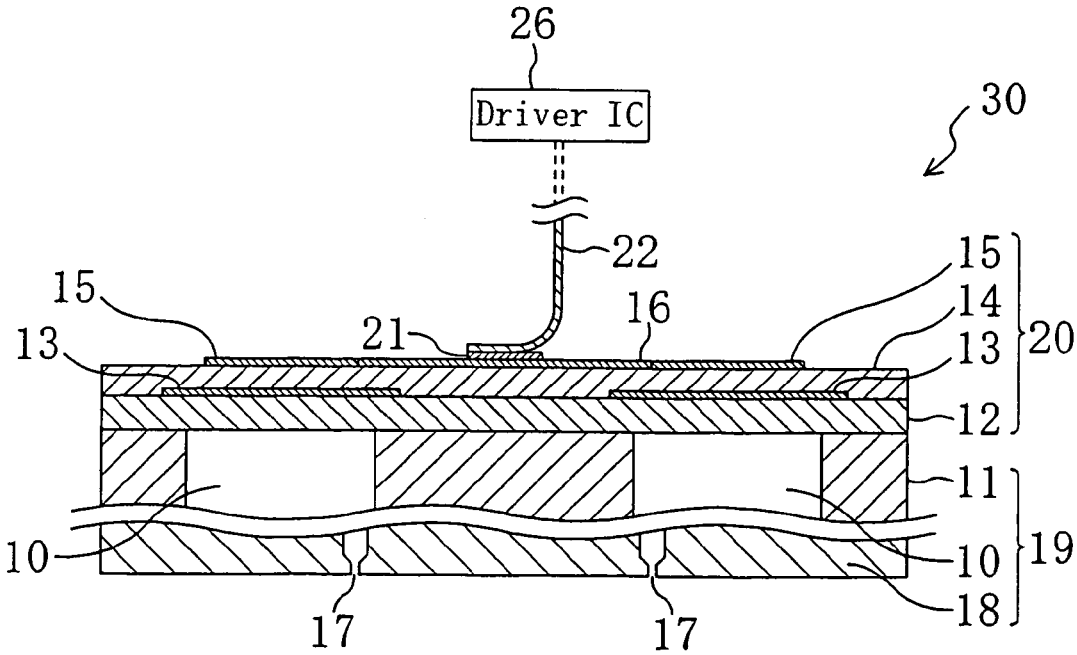
FIG. 3 is a cross-sectional view taken along line III—III of FIG. 2.
Figure 4:
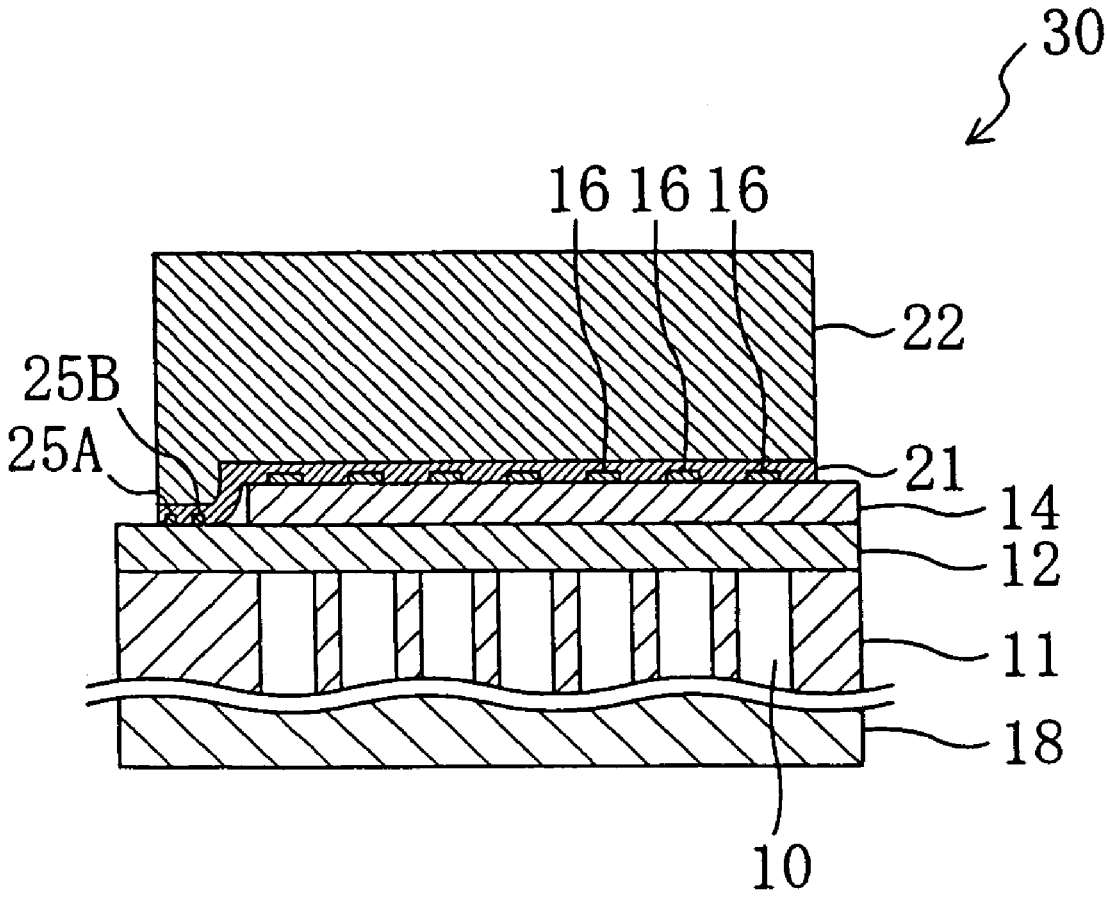
FIG. 4 is a cross-sectional view taken along line IV—IV of FIG. 2.

As illustrated in FIG. 2 to FIG. 4, the ink jet head 30 includes a nozzle plate 18 in which a plurality of nozzles 17 are provided, an ink channel substrate 11 in which the same number of pressure chambers 10 as the number of nozzles 17 are provided, a vibration plate 12, scanning electrodes 13 extending over the pressure chambers 10, a piezoelectric element 14 made of PZT, and recording electrodes 15 placed respectively over the pressure chambers 10, which are layered in this order. The nozzle plate 18 and the ink channel substrate 11 together form a head assembly 19, and the vibration plate 12, the scanning electrode 13, the piezoelectric element 14 and the recording electrode 15 together form an actuator 20.

The pressure chambers 10 are provided in two columns that are next to each other in the horizontal direction (the direction L1), and a large number (e.g., on the order of 10 to 1000) of pressure chambers 10 are provided along each column extending in the vertical direction (the direction L2). Note however that in this and other subsequent embodiments, only seven pressure chambers 10 are shown to be present in the vertical direction for ease of understanding. As illustrated in FIG. 3, each pressure chamber 10 has an elongate shape extending in the horizontal direction. Each pressure chamber 10 is communicated to the nozzle 17 in the nozzle plate 18 near one side of the pressure chamber 10 that is closer to the center of the head assembly 19 in the horizontal direction.

The actuator 20 is a so-called "flexural vibration type" actuator. In the actuator 20, when the scanning electrode 13 and the recording electrode 15 are both turned ON, a voltage is applied across the piezoelectric element 14, whereby the piezoelectric element 14 expands/contracts in the longitudinal direction. The expansion/contraction of the piezoelectric element 14 is restricted by the vibration plate 12, whereby the entire actuator 20 undergoes flexural deformation to increase/decrease the volume of the pressure chamber 10. As the volume of the pressure chamber 10 increases/decreases, the ink pressure in the pressure chamber 10 increases/decreases, thereby discharging ink in the form of a droplet through the nozzle 17.

As illustrated in FIG. 2, the actuators 20 are arranged in a pattern similar to that of the pressure chambers 10. Specifically, m (where m=2) actuators 20 are provided in the horizontal direction, and n (where n is on the order of 10 to 1000) actuators 20 provided in the vertical direction. For actuators that are adjacent to each other in the horizontal direction, the recording electrodes 15 are connected to each other via a lead wire 16 extending in the horizontal direction. Actuators whose recording electrodes 15 are connected to each other form an "actuator row" in terms of electrical circuit. Actuators that are adjacent to each other in the vertical direction share an integrated scanning electrode 13. Actuators that share an integrated scanning electrode 13 form an "actuator column" in terms of electrical circuit. In the present embodiment, the scanning electrodes 13 include a first scanning electrode 13A and a second scanning electrode 13B, which are next to each other in the horizontal direction. The first scanning electrode 13A and the second scanning electrode 13B each form a part of a first actuator column 20A and a second actuator column 20B, respectively.

Thus, in the present embodiment, actuators are arranged in a matrix pattern of n rows by m columns both in terms of electrical circuit and geometrically. An actuator that is geometrically located along the $p^{th}$ row and the $q^{th}$ column (where p is a natural number of 1 to n, and q is a natural number of 1 to m) is located along the $p^{th}$ row and the $q^{th}$ column also in terms of electrical circuit. Thus, in the present embodiment, each actuator row includes m actuators 20 arranged in the horizontal direction. Each of the actuator columns 20A and 20B includes n actuators 20 arranged in the vertical direction.

The first scanning electrode 13A is formed in a rectangular shape as viewed from above and is facing all of the recording electrodes 15 of the first actuator column 20A, and the second scanning electrode 13B is formed in a rectangular shape as viewed from above and is facing all of the recording electrodes 15 of the second actuator column 20B. Note however that the scanning electrodes 13A and 13B are not limited to a rectangular shape as viewed from above or any other particular shape as long as they are facing the recording electrodes 15 of the actuator columns 20A and 20B, respectively.

As illustrated in FIG. 2, the recording electrode 15 is formed in an elongate shape extending in the horizontal direction, as is the pressure chamber 10, and is slightly smaller than the pressure chamber 10.

As illustrated in FIG. 3, the nozzles 17 that are next to each other in the horizontal direction are spaced apart from each other by a certain interval therebetween for avoiding interference between the nozzles 17. Accordingly, the first actuator column 20A and the second actuator column 20B are also spaced apart from each other by a certain interval therebetween. In the present embodiment, a relay terminal section 21 is formed in the inter-column space between the actuator columns 20A and 20B so as to make use of the space therebetween. Thus, the relay terminal section 21 is provided in a central portion of the head assembly 19 with respect to the horizontal direction.

The relay terminal section 21 is made of an anisotropic conductive sheet (ACF) having an elongate rectangular shape, as viewed from above, extending in the vertical direction. The relay terminal section 21 is a relay terminal connected to an FPC (flexible printed circuit board) 22, which is connected to a driving circuit 26. Note that the FPC 22 is not shown in FIG. 2 for ease of understanding. As illustrated in FIG. 4, the relay terminal section 21 are provided over the lead wire 16, extending from the recording electrode 15, and lead wires 25A and 25B, extending from the scanning electrodes 13A and 13B, respectively, so as to cover the lead wires 16, 25A and 25B. The FPC 22 is connected to the upper side of the relay terminal section 21.

The driving circuit 26 supplies scanning signals to the scanning electrodes 13A and 13B, and recording signals to the recording electrodes 15. A scanning signal and a recording signal are superimposed on each other to form a driving signal. Next, referring to FIG. 5A to FIG. 5E, various signals supplied from the driving circuit 26 will be described.

As illustrated in FIG. 5A, the scanning electrodes 13 are periodically turned ON/OFF at cycle T, so that the scanning electrode 13A of the first column and the scanning electrode 13B of the second column are turned ON/OFF alternately. As illustrated in FIG. 5C, the scanning signal is a signal of a constant potential. As a result, the scanning signal is turned ON while the scanning electrode 13 is ON, and turned OFF while the scanning electrode 13 is OFF.

As illustrated in FIG. 5B, the recording signal is a pulse signal that is turned ON when ink is discharged, and turned OFF when ink is not discharged. A voltage is applied across the piezoelectric element 14 of the actuator 20 only when the scanning signal and the recording signal are both ON. Thus, ink is discharged when both of the signals are ON, and is not discharged when one or both of the signals is/are OFF. As described above, in the present ink jet head 30, the ink discharge is controlled by the combination of the scanning signal and the recording signal.

In the present ink jet head 30, the scanning electrodes 13 and the recording electrodes 15 for driving the piezoelectric elements 14 of the actuators 20 are arranged in a matrix pattern of n rows by m columns, whereby the number of channels of the driving circuit 26 can be reduced. Specifically, the number of channels is reduced from n*m to n+m. Thus, the cost for the driving circuit 26 can be reduced.

Since the relay terminal section 21 is provided in the inter-column space between the first actuator column 20A and the second actuator column 20B, it is possible to reduce the distance between the relay terminal section 21 and the actuator columns 20A and 20B. Therefore, the lead wires 16, 25A and 25B can be provided in shorter lengths, and thus the speed of signal transmission can be increased. Moreover, the electrical resistances of the lead wires 16, 25A and 25B can be reduced.

In addition, since the distance between the relay terminal section 21 and the first actuator column 20A is equal to the distance between the relay terminal section 21 and the second actuator column 20B, the actuators of the actuator column 20A and those of the actuator column 20B have an equal electrical resistance R and an equal electrostatic capacity C, whereby the gradient of the signal waveform is equalized therebetween. Therefore, the ink discharging performance is unlikely to vary between the actuator columns. Moreover, it is likely that the scanning signal and the recording signal can be reliably synchronized with each other. Thus, the ink discharging performance is improved.

Figure 6:
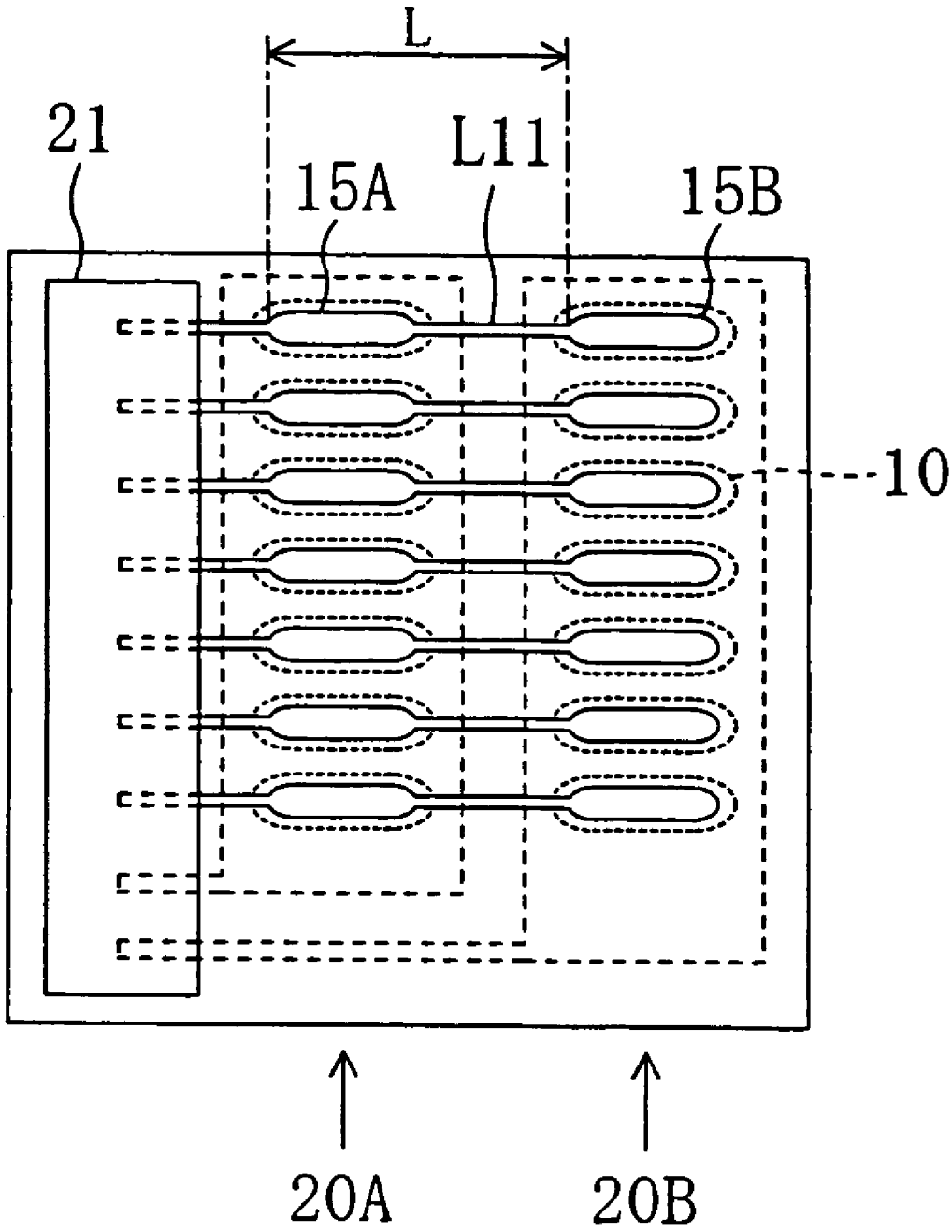
FIG. 6 is a plan view illustrating an ink jet head according to a comparative example.

For example, if the relay terminal section 21 is placed on either side, as illustrated in FIG. 6, the difference in time constant CR between the first actuator column 20A and the second actuator column 20B increases. In the illustrated arrangement, the line resistance between the relay terminal section 21 and a recording electrode 15B of the second actuator column 20B and the line resistance between the relay terminal section 21 and a recording electrode 15A of the first actuator column 20A are different from each other by the resistance of the recording electrode 15A and a wire L11. Then, the difference in time constant CR is 0.1 μs, assuming that the electrostatic capacity of the actuator 20 is 150 pF, the recording electrode 15A and the wire L11 are made of platinum whose volume resistivity is $1.05\times10^{-5}$ Ω·cm, the recording electrode 15A has a thickness of 0.05 μm, a width of 25 μm and a length of 2000 μm, and the wire L11 has a thickness of 0.05 μm, a width of 10 μm and a length of 2400 μm. Therefore, where a pulse signal is input as the recording signal, the gradient of the rising/falling edge of an actual pulse signal supplied to the recording electrode 15B is smaller as compared to the recording electrode 15A by the difference in time constant CR.

In order to examine the relationship between a difference in time constant CR and variations in the ink discharging performance, an experiment was conducted where two different pulse signals having different rising/falling edge gradients were applied to the same actuator. This experiment simulates a situation where the same pulse signal is applied to two different actuators having different time constants. The experiment revealed that for an actuator that discharges ink droplets with a drop size of 5 pl and an ink discharging velocity of 7.1 m/s, if the time constant increases by 0.1 μs, the drop size and the ink discharging velocity changed from the original values to 4.9 pl and 7 m/s, respectively. The change in drop size was 2%. It is believed that a desirable level of ink discharging performance can be normally maintained if the error in drop size is within 2%. Therefore, it is inferred that a desirable level of ink discharging performance can be obtained by appropriately arranging actuators and wires so that the difference in time constant is 0.1 μs or less.

EMBODIMENT 2

Figure 7:
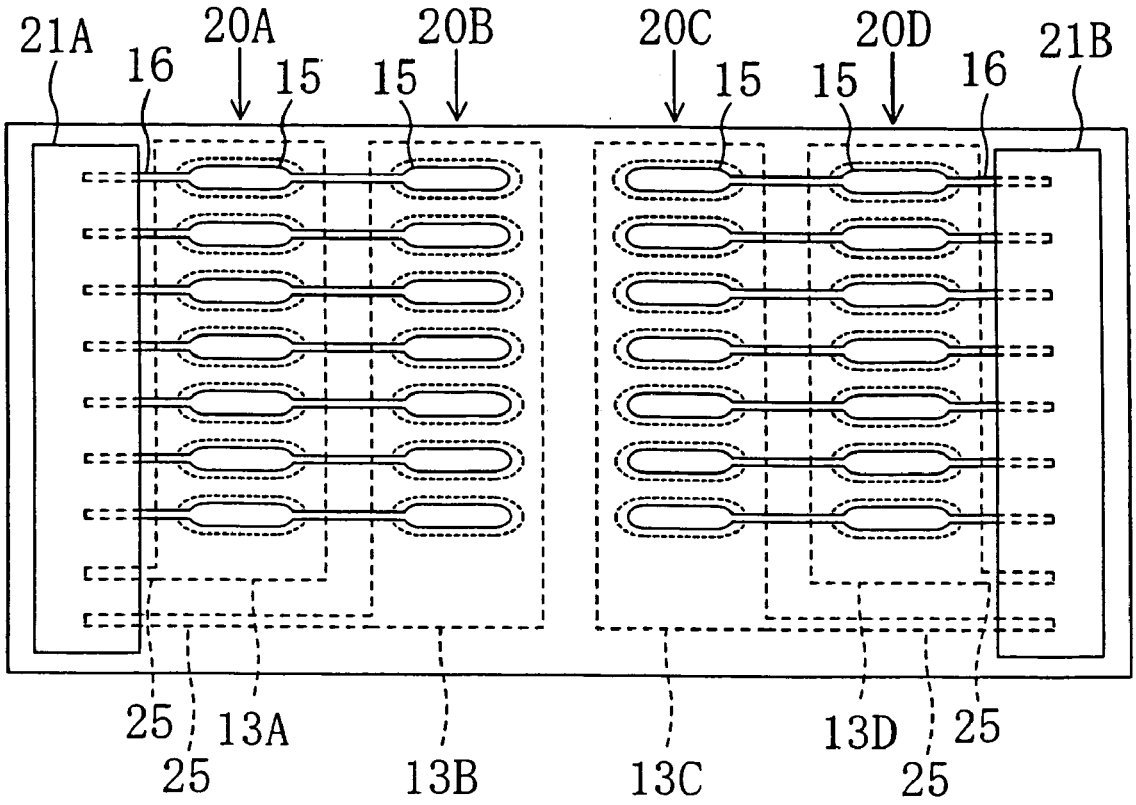
FIG. 7 is a plan view illustrating an ink jet head according to Embodiment 2.

The ink jet head 30 according to Embodiment 2 includes four actuator columns with two relay terminal sections provided on opposite sides of the array of the four actuator columns, as illustrated in FIG. 7.

The first to fourth actuator columns 20A to 20D extend in the vertical direction and each include a plurality of actuators 20, and the actuator columns 20A to 20D are arranged next to each other in the horizontal direction. A first relay terminal section 21A is provided on the left side of the first actuator column 20A, and a second relay terminal section 21B is provided on the right side of the fourth actuator column 20D.

Each recording electrode 15 of the first actuator column 20A is connected to the first relay terminal section 21A via the lead wire 16 extending in the horizontal direction. Moreover, the recording electrode 15 of the first actuator column 20A and the recording electrode 15 of the second actuator column 20B that belong to the same row are connected to each other via the lead wire 16. Similarly, the recording electrode 15 of a third actuator column 20C and the recording electrode 15 of a fourth actuator column 20D that belong to the same row are connected to each other via the lead wire 16. Each recording electrode 15 of the fourth actuator column 20D is connected to the second relay terminal section 21B via the lead wire 16.

The scanning electrode 13A of the first actuator column 20A and the scanning electrode 13B of the second actuator column 20B are each connected to the first relay terminal section 21A via a lead wire 25 extending in the horizontal direction. A scanning electrode 13C of the third actuator column 20C and a scanning electrode 13D of the fourth actuator column 20D are each connected to the second relay terminal section 21B via the lead wire 25 extending in the horizontal direction.

Next, referring to FIG. 8A to FIG. 8G, the scanning signal and the recording signal supplied from the driving circuit 26 will be described.

As illustrated in FIG. 8A, the scanning electrodes 13 are periodically turned ON/OFF at cycle T. The scanning electrode 13A of the first column and the scanning electrode 13C of the third column are turned ON/OFF synchronously, and the scanning electrode 13B of the second column and the scanning electrode 13D of the fourth column are turned ON/OFF synchronously. As illustrated in FIG. 8C, the scanning signal is a signal of a constant potential. As illustrated in FIG. 8B, the recording signal is a pulse signal that is turned ON when ink is discharged, and turned OFF when ink is not discharged. As in Embodiment 1, in the present embodiment, ink is discharged when both of the scanning signal and the recording signal are ON.

In Embodiment 2, the two relay terminal sections 21A and 21B are provided, wherein the scanning electrodes 13 and the recording electrodes 15 of the actuators 20 on the left side of the head assembly 19 are connected to the first relay terminal section 21A on the left side, while the scanning electrodes 13 and the recording electrodes 15 of the actuators 20 on the right side are connected to the second relay terminal section 21B on the right side. Therefore, as compared to a case where relay terminal sections are locally arranged on one side of the head assembly, the lead wires 16 and 25 for connecting the relay terminal sections 21A and 21B with the electrodes 13 and 15 can be provided in shorter lengths. Thus, as in Embodiment 1, the speed of signal transmission can be increased. Moreover, the electrical resistances of the lead wires 16 and 25 can be reduced, thereby stabilizing the ink discharging performance. Moreover, the variations in the ink discharging performance among the actuator columns 20A to 20D can be better suppressed.

EMBODIMENT 3

In Embodiment 2, the relay terminal sections 21A and 21B are provided on opposite sides of the array of actuator columns. Alternatively, the relay terminal sections 21A and 21B may be provided in inter-column spaces between actuator columns.

Figure 9A:
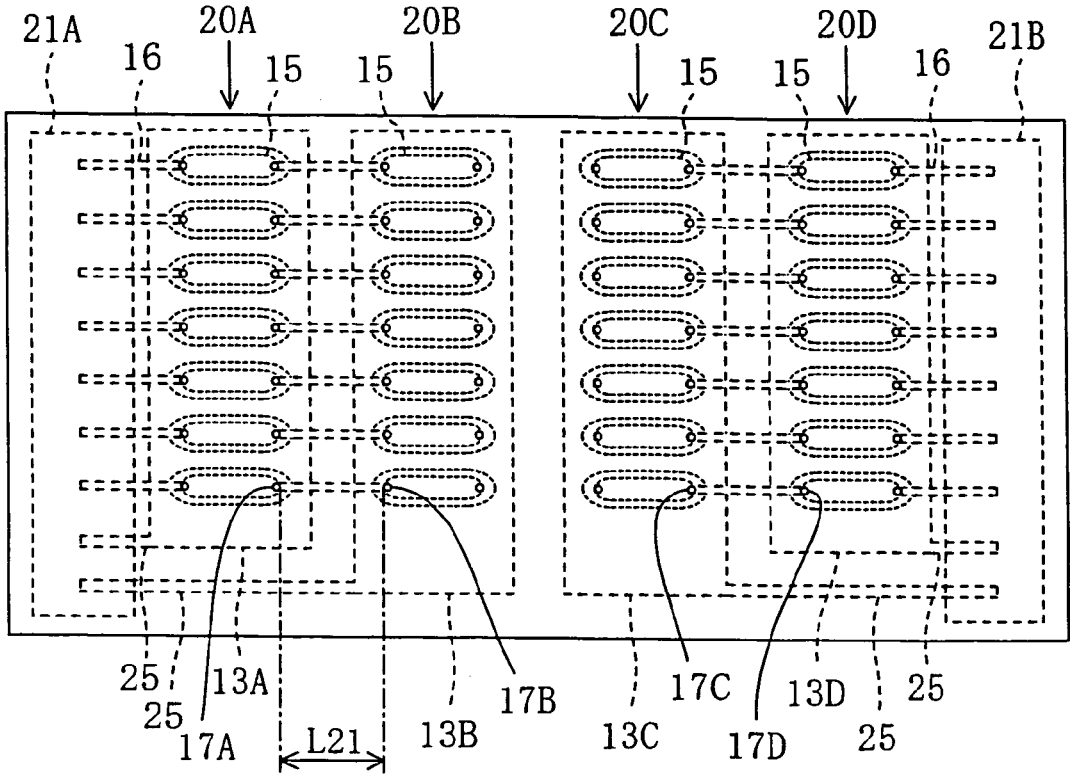
FIG. 9A is a bottom view illustrating an ink jet head according to a comparative example of Embodiment 3.
Figure 9B:
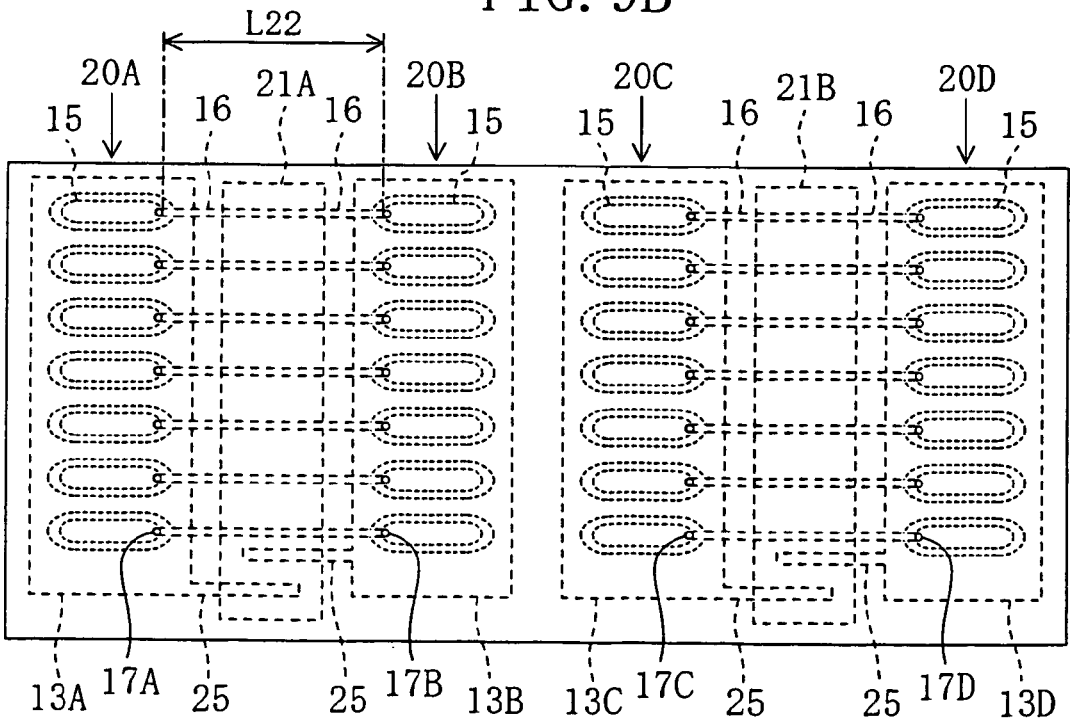
FIG. 9B is a bottom view illustrating an ink jet head according to Embodiment 3.

In Embodiment 3, the first relay terminal section 21A is provided between the first actuator column 20A and the second actuator column 20B, and the second relay terminal section 21B is provided between the third actuator column 20C and the fourth actuator column 20D, as illustrated in FIG. 9B.

Each of nozzles 17A to 17D is provided on one side of the pressure chamber 10 that is closer to the nearest relay terminal section in the horizontal direction. Specifically, the nozzle 17A associated with the first actuator column 20A is provided on one side of the pressure chamber 10 that is closer to the second actuator column 20B, and the nozzle 17B associated with the second actuator column 20B is provided on one side of the pressure chamber 10 that is closer to the first actuator 20A. Moreover, the nozzle 17C associated with the third actuator column 20C is provided on one side of the pressure chamber 10 that is closer to the fourth actuator column 20D, and the nozzle 17D associated with the fourth actuator column 20D is provided on one side of the pressure chamber 10 that is closer to the third actuator column 20C.

According to Embodiment 3, the lead wires 16 and 25 for connecting the relay terminal sections 21A and 21B with the electrodes 13 and 15 can be provided in even shorter lengths. Therefore, it is possible to further stabilize the ink discharging performance. Moreover, the variations in the ink discharging performance among the actuator columns 20A to 20D can be further suppressed.

Moreover, according to Embodiment 3, the distance between the nozzle 17A associated with the first actuator column 20A and the nozzle 17B associated with the second actuator column 20B, and the distance between the nozzle 17C associated with the third actuator column 20C and the nozzle 17D associated with the fourth actuator column 20D, are increased by the presence of the relay terminal sections 21A and 21B, respectively. Thus, a nozzle interval L22 of the present embodiment is greater than a nozzle interval L21 where the relay terminal sections 21A and 21B are provided on opposite sides of the array of actuator columns (see FIG. 9A). Therefore, it is possible to prevent mixing of ink (e.g., mixing of colors) from occurring due to short nozzle intervals.

Note that in the present embodiment, the nozzles 17A to 17D are each provided on one side of the pressure chamber that is closer to the relay terminal section in the longitudinal direction. However, the ink jet head of the present invention is not limited to the present embodiment, and the nozzle position is not limited to any particular position.

EMBODIMENT 4

In the ink jet head according to Embodiment 4, the arrangement pattern of the scanning electrodes is modified so as to prevent crosstalk from occurring between adjacent actuators.

Figure 10:
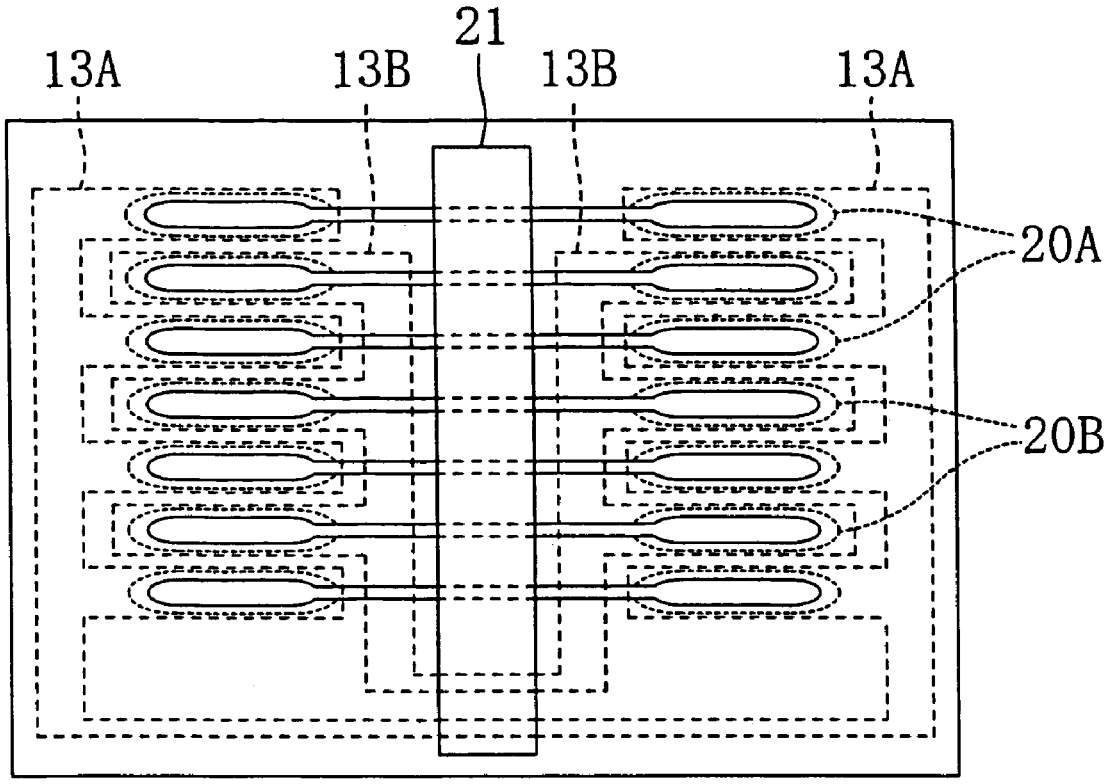
FIG. 10 is a plan view illustrating an ink jet head according to Embodiment 4.

As does the ink jet head of Embodiment 1, the ink jet head illustrated in FIG. 10 includes n rows by 2 columns of actuators in terms of electrical circuit, with the relay terminal section 21 being geometrically arranged in the inter-column space in the middle between the actuator columns. However, unlike Embodiment 1, the first scanning electrode 13A and the second scanning electrode 13B are each formed in a comb-shaped pattern so that they mesh with each other on each side of the head assembly 19. Thus, in terms of electrical circuit, actuators of the first column and those of the second column are arranged in an alternating pattern in the vertical direction. Two actuators of the same row and of the same column in terms of electrical circuit are arranged next to each other via the relay terminal section 21 therebetween in the horizontal direction.

Signals similar to those of Embodiment 1 are supplied from the driving circuit 26. The scanning signal is applied alternately to the scanning electrodes 13A of the first actuator column 20A and the scanning electrodes 13B of the second actuator column 20B. Therefore, the scanning signal will not be applied simultaneously to the scanning electrodes 13A and 13B, whereby the actuators of the first actuator column 20A and those of the second actuator column 20B will not be activated at the same time. Thus, adjacent actuators (those that are adjacent to each other in the vertical direction in the illustrated example) will not be activated at the same time, thereby suppressing the occurrence of crosstalk, i.e., the ink discharge volume of one actuator being influenced by whether an adjacent actuator is being active/inactive.

Figure 11:
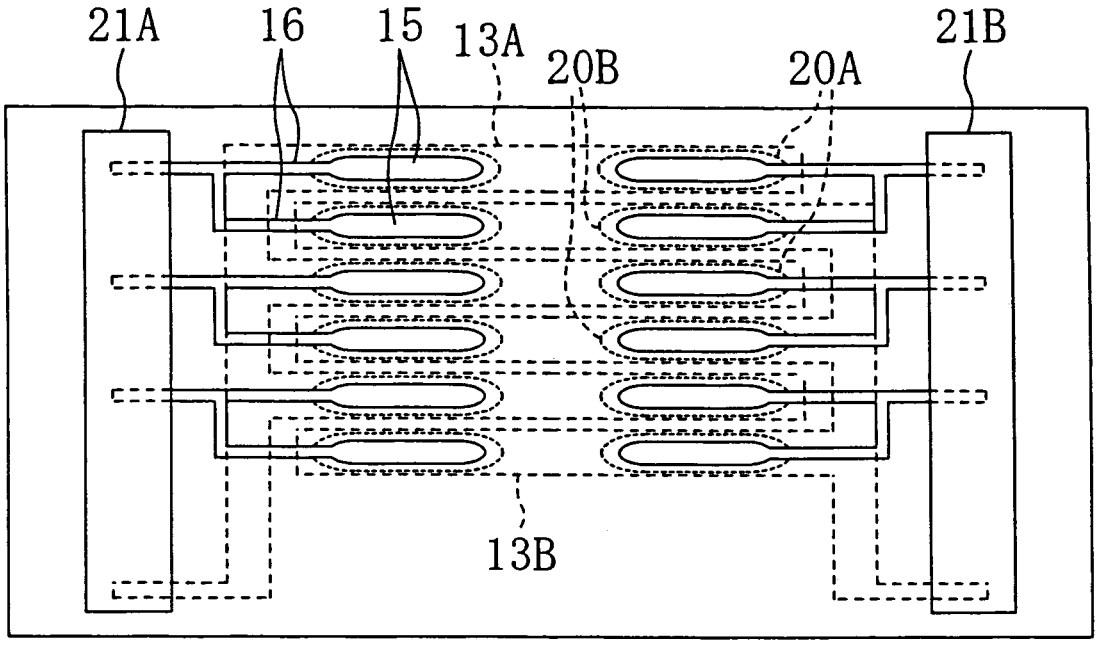
FIG. 11 is a plan view illustrating an ink jet head according to Embodiment 4.

The ink jet head illustrated in FIG. 11 includes n rows by 2 columns of actuators in terms of electrical circuit, and two relay terminal sections 21A and 21B geometrically arranged at opposite ends of the head assembly 19 in the horizontal direction. The first scanning electrode 13A and the second scanning electrode 13B are each formed in a comb-shaped pattern so that they mesh with each other. In the present ink jet head, actuators of the same row in terms of electrical circuit are arranged next to each other in the vertical direction. Moreover, actuators arranged next to each other the horizontal direction belong to the same column in terms of electrical circuit. Each lead wire 16 extending from the relay terminal sections 21A and 21B diverges into two branches, which are connected respectively to the recording electrode 15 of one actuator 20 of the first actuator column and the recording electrode 15 of one actuator 20 of the second actuator column.

Also in the present ink jet head, adjacent actuators will not be activated at the same time, thereby suppressing the occurrence of crosstalk.

Moreover, in the present ink jet head, the layout density of lead wires on the relay terminal sections 21A and 21B is about one half of the layout density of actuators in the vertical direction. Therefore, even if the density of actuators is high, the circuit can be implemented easily.

Figure 12:
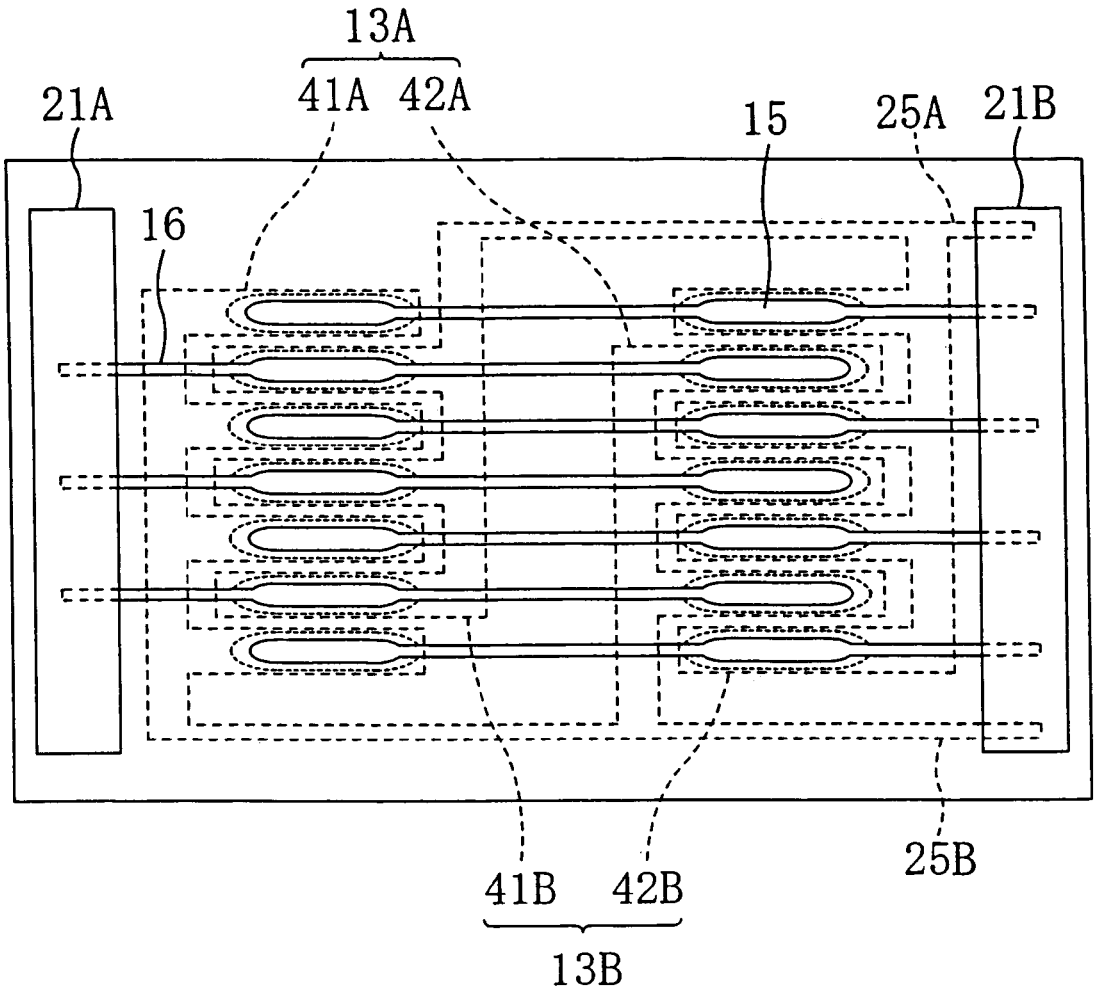
FIG. 12 is a plan view illustrating an ink jet head according to Embodiment 4.

The ink jet head illustrated in FIG. 12 also includes n rows by 2 columns of actuators in terms of electrical circuit, and two relay terminal sections 21A and 21B geometrically arranged at opposite ends of the head assembly 19 in the horizontal direction. The first scanning electrode 13A includes comb-shaped scanning electrodes 41A and 42A arranged on the left side and on the right side, and the second scanning electrode 13B includes comb-shaped scanning electrodes 41B and 42B arranged on the left side and on the right side. The scanning electrode 41A and the scanning electrode 41B are arranged so that they mesh with each other. The scanning electrode 42A and the scanning electrode 42B are also arranged so that they mesh with each other.

Also in the present ink jet head, actuators of the first column and actuators of the second column are arranged alternately in the vertical direction. In addition, in the present ink jet head, an actuator of the first column and an actuator of the second column are adjacent to each other in the horizontal direction. Thus, actuators of the same row but of different columns in terms of electrical circuit are arranged next to each other in the horizontal direction.

In the present ink jet head, actuators adjacent to each other in the horizontal direction will not be activated at the same time, in addition to that actuators adjacent to each other in the vertical direction will not be activated at the same time, thereby further suppressing the occurrence of crosstalk.

Moreover, also in the present ink jet head, the layout density of lead wires on the relay terminal sections 21A and 21B is about one half of the layout density of actuators in the vertical direction. Therefore, even if the density of actuators is high, the circuit can be implemented easily.

Note that while the lead wire 25A of the first scanning electrode 13A and the lead wire 25B of the second scanning electrode 13B are both connected to the second relay terminal section 21B in the present ink jet head, one or both of the lead wires 25A and 25B may alternatively be connected to the first relay terminal section 21A.

According to the present embodiment, the occurrence of crosstalk is suppressed, whereby it is possible to further improve the ink discharging performance.

EMBODIMENT 5

The ink jet head according to Embodiment 5 is similar to the ink jet head of Embodiment 1, except that the recording signal or the scanning signal is modified according to the characteristics of each actuator column.

In some cases, the amount of deformation of an actuator or the volume of a pressure chamber may vary among different columns, depending on the configuration of the ink jet head. Moreover, in a case where different types of ink are used for different columns, the characteristics of ink (e.g., the viscosity) may vary among different columns. In such a case, by adjusting signals to be supplied to actuators for each column, it is possible to suppress the variations in the ink discharging performance among different columns. Alternatively, it is possible to control the ink discharge in a more versatile manner by actively varying the ink discharge volume, etc., among different columns.

For example, in a case where the amount of deformation of the actuators of the first column is greater than that of the actuators of the second column, the ink discharge volume of the actuators of the first column is greater than that of the actuators of the second column, if driving signals of the same voltage are supplied to the actuators of both columns, thereby resulting in variations in the ink discharging performance. However, if the voltage applied to the actuators of the first column is set to be smaller than the voltage applied to the actuators of the second column so that the actuators of both columns are deformed by an equal amount, it is possible to suppress the variations in the ink discharging performance.

Thus, in the present embodiment, driving signals of different voltages are applied to actuators of different columns.

The ink jet head of the present embodiment has a configuration similar to that of Embodiment 1 (see FIG. 1 to FIG. 4). In the present embodiment, however, ink of the same type is stored in a plurality of pressure chambers 10 arranged in the vertical direction, whereas different types of ink are stored in the pressure chambers 10 on the left side and in the pressure chambers 10 on the right side.

As illustrated in FIG. 13A to FIG. 13E, the voltage of the recording signal applied to the recording electrodes 15 of the first column is different from that of the recording signal applied to the recording electrodes 15 of the second column, while the voltages of the scanning signals applied to these columns are the same. Specifically, the potential of the pulse supplied to the recording electrodes 15 of the first column is V1, and the potential of the pulse supplied to the recording electrodes 15 of the second column is V2 (<V1). As a result, the voltage of the driving signal supplied to the actuators of the first column is V1, and that of the driving signal supplied to the actuators of the second column is V2. In such a case, the actuators of the first column deform by a greater amount than the actuators of the second column. Therefore, in a case where the ink of the first column is less easily discharged than the ink of the second column, for example, the variations in the ink discharge volume can be corrected by using such signals.

Alternatively, the voltage applied to the scanning signals of the first column may be higher than that applied to the scanning signals of the second column while applying recording signals of the same voltage to these columns, as illustrated in FIG. 14A to FIG. 14E. Also in such a case, the voltage of the driving signal of the first column is higher than that of the driving signal of the second column.

Note that although not shown in the figures, the voltage of the driving signal can be varied between the columns alternatively by varying both the recording signal and the scanning signal between the columns.

According to the present embodiment, a driving signal is formed by the combination of a recording signal and a scanning signal so that the voltage of the driving signal is different for each column, whereby it is possible to adjust the amount of actuator deformation and the ink discharging performance for each column without complicating the configuration of the driving circuit. Therefore, with a simple configuration, it is possible to drive the actuators according to the ink characteristics and the actuator characteristics for each column.

EMBODIMENT 6

Two actuator columns are provided in Embodiment 5. However, the number of actuator columns is not limited to two, but may alternatively be three or more.

Figure 15:
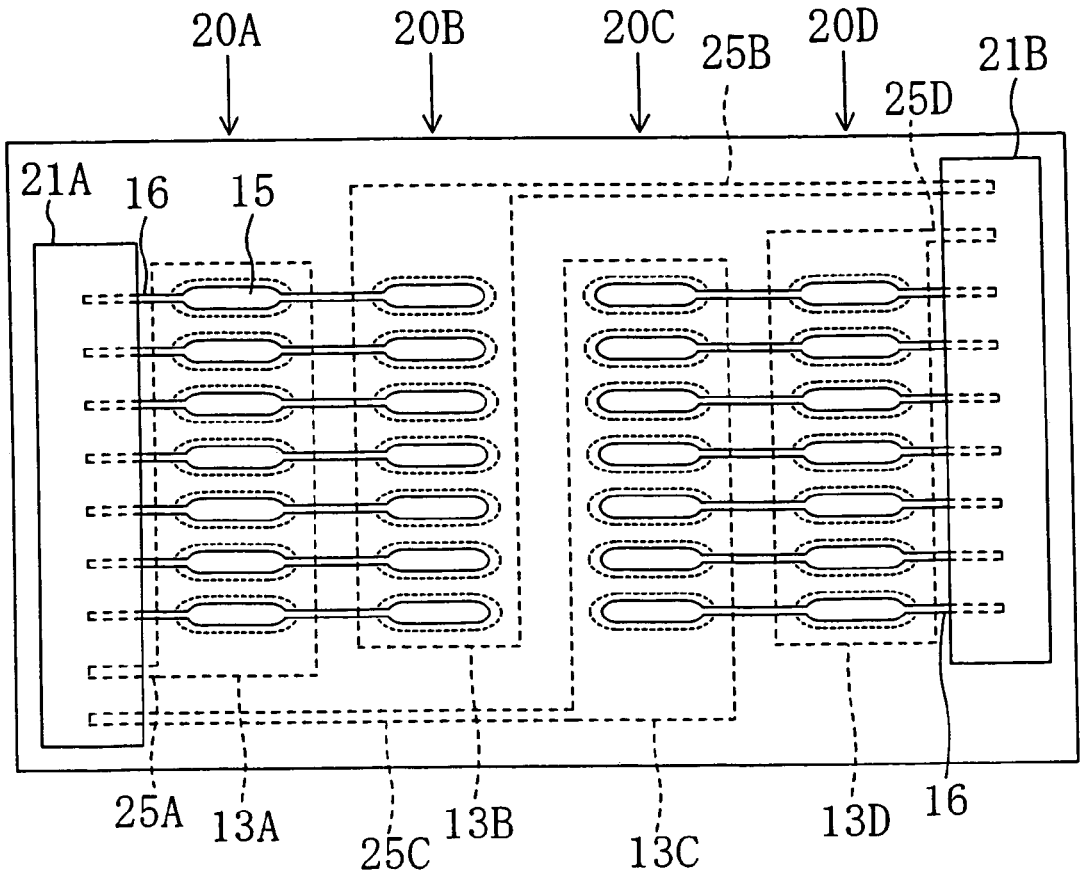
FIG. 15 is a plan view illustrating an ink jet head according to Embodiment 6.

For example, the number of actuator columns may be four, as in the ink jet head of Embodiment 2 (see FIG. 7). Alternatively, an ink jet head may include four actuator columns as illustrated in FIG. 15, for example. In such an ink jet head, recording signals of two different potentials and scanning signals of two different potentials may be combined together to produce driving signals of a total of four different voltage levels. In the present embodiment, four columns of actuators and four columns of pressure chambers are provided.

A different type of ink is stored in the pressure chambers of each of the first to fourth columns. In the present embodiment, ink of a different color is stored in pressure chambers of each column, and a total of four colors of ink are stored in the entire head. Thus, the present ink jet head is capable of color recording.

In the ink jet head illustrated in FIG. 15, the scanning electrodes 13A to 13D of the first to fourth actuator columns 20A to 20D are each formed in a rectangular shape, as viewed from above, extending in the vertical direction, and the scanning electrodes 13A to 13D are arranged next to one another in the horizontal direction. The recording electrodes 15 of the first actuator column and the recording electrodes 15 of the second actuator column are connected to each other, and are connected to the first relay terminal section 21A at the left end of the head assembly 19 via the lead wires 16. The recording electrodes 15 of the third actuator column and the recording electrodes 15 of the fourth actuator column are connected to each other, and are connected to the second relay terminal section 21B at the right end of the head assembly 19 via the lead wires 16.

The scanning electrode 13A of the first actuator column is connected to the first relay terminal section 21A via the lead wire 25A. The scanning electrode 13B of the second actuator column is connected to the second relay terminal section 21B via the lead wire 25B. The scanning electrode 13C of the third actuator column is connected to the first relay terminal section 21A via a lead wire 25C. The scanning electrode 13D of the fourth actuator column is connected to the second relay terminal section 21B via a lead wire 25D.

In the present embodiment, signals as illustrated in FIG. 16A to FIG. 16H are supplied to the actuators. Specifically, the scanning electrodes 13A to 13D are controlled so that a state where the first and third columns are ON while the second and fourth columns are OFF alternates with another state where the first and third columns are OFF while the second and fourth columns are ON.

The scanning signal for the first and second columns is a signal of a constant potential (=0). On the other hand, the scanning signal for the third and fourth columns is a pulse signal in which a potential V (≠0) appears repeatedly at cycle T.

The recording signal includes a first pulse of a first potential V1 and a second pulse of a second potential V2 (<V1), and the first pulse and the second pulse are repeated in an alternating manner in synchronization with the scanning electrode being turned ON/OFF.

By combining the scanning signal and the recording signal, the voltages of the driving signals of the actuators for the first, second, third and fourth columns are V1, V2, V+V1 and V+V2, respectively.

In the present embodiment, driving signals of a total of four different voltage levels are produced by combining the recording signal having two different potentials with the scanning signal having two different potentials. Also in the present embodiment, it is possible to drive the actuators according to the ink characteristics and the actuator characteristics for each column without complicating the configuration of the driving circuit.

According to the present embodiment, it is possible to adjust the voltage of the driving signal for each column according to the actuator characteristics of the column. Therefore, it is possible to correct the driving signal according to the ink discharging performance for each column, thereby suppressing the variations in the ink discharging performance. Moreover, it is possible to vary the ink discharging characteristics among different columns, thereby realizing a more complicated ink discharge control.

As an alternative example, the driving signal as described above may be used with the ink jet head of Embodiment 3 (see FIG. 9B). In the present example, a black (BK) pigment ink is stored in the pressure chambers associated with the first actuator column 20A, a cyan (C) dye ink is stored in the pressure chambers associated with the second actuator column 20B, a magenta (M) dye ink is stored in the pressure chambers associated with the third actuator column 20C, and a yellow (Y) dye ink is stored in the pressure chambers associated with the fourth actuator column 20D. Thus, a pigment ink and dye inks are used together in the same head.

A pigment ink and a dye ink differ from each other in how easily they seep into a recording medium. Therefore, in a case where paper is used as the recording medium, for example, the diameter of the ink dot formed on the recording paper is smaller with a pigment ink than with a dye ink even if the drop size of the ink droplet to be discharged is the same. Therefore, in order to realize the same dot diameter among the various colors, the drop size of the black ink needs to be larger than those of the inks of the other colors.

Nevertheless, according to the present embodiment, it is possible to easily vary the driving signal among different actuator columns by adjusting the combination of the scanning signal and the recording signal. Therefore, it is easy to make the drop size of the black ink larger than those of the inks of the other colors.

Figure 17:
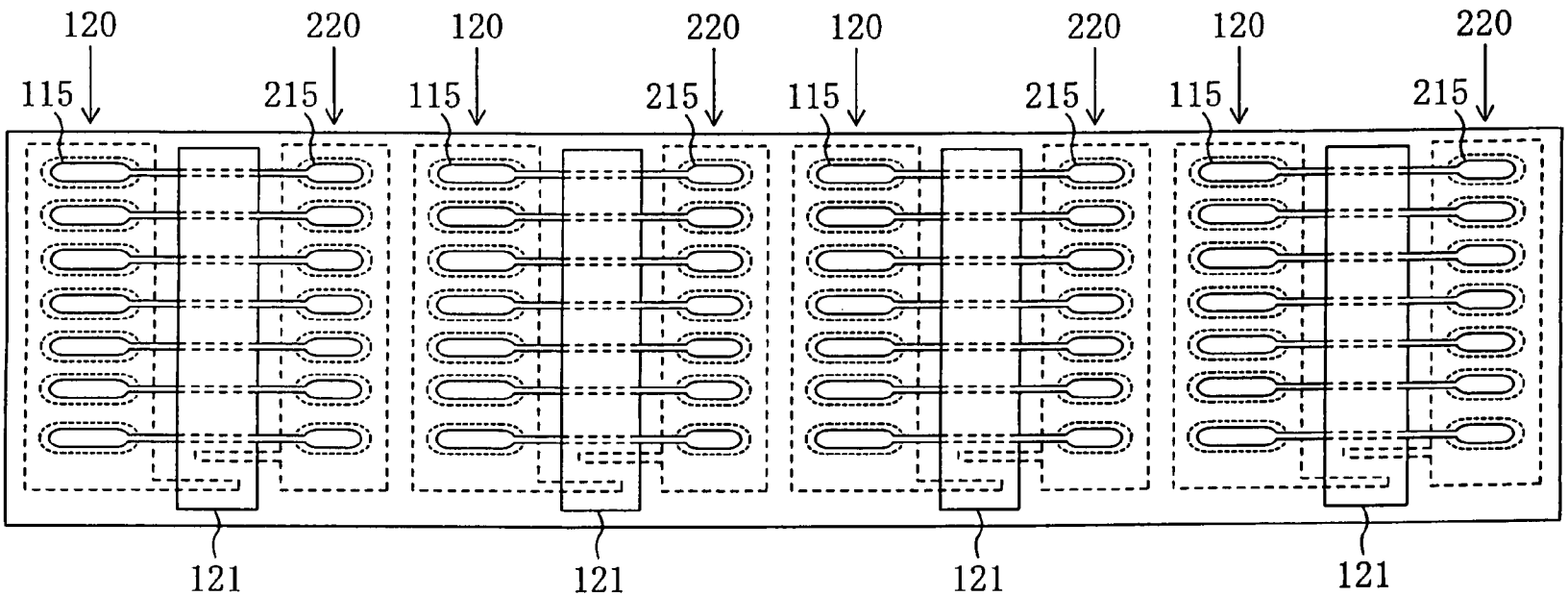
FIG. 17 is a plan view illustrating an ink jet head according to Embodiment 6.
Figures 21A, 21B, 21C, 21D, 21E:
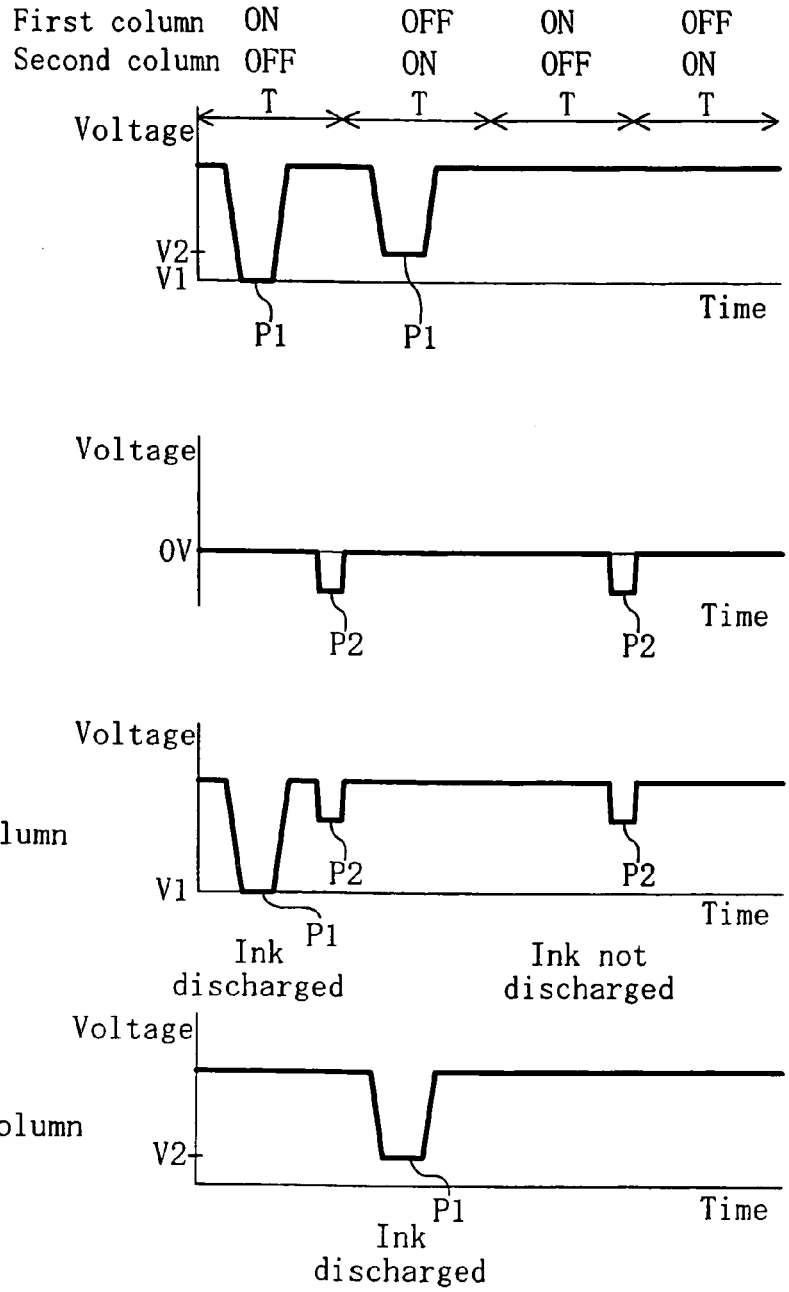
FIG. 21A to FIG. 21E are waveform diagrams illustrating signals used in Embodiment 7.

The ink jet head illustrated in FIG. 17 includes two actuator columns of different ink discharge volumes for each color. In the ink jet head, the actuator blocks for discharging inks of different colors of black (BK), cyan (C), magenta (M) and yellow (Y) each include a first actuator column 120 and a second actuator column 220. A relay terminal section 121 is provided for each color and is located between the first actuator column 120 and the second actuator column 220.

The volume of each pressure chamber 115 associated with the first actuator column 120 is different from that of each pressure chamber 215 associated with the second actuator column 220. In this example, the volume of each pressure chamber 115 is larger than that of the pressure chamber 215. Note that also actuators of different columns have different sizes.

In a case where there are pressure chambers of different volumes as described above, the natural frequency of the vibration system of an actuator (the entire vibration system including the ink) takes a different value for each column. Therefore, it is difficult to obtain a desirable level of ink discharging performance by supplying the same driving signal for different columns. Nevertheless, according to the present embodiment, it is possible to easily vary the driving signal among different actuator columns by adjusting the combination of the scanning signal and the recording signal. Therefore, even if the volume of a pressure chamber varies among two actuator columns, it is relatively easy to adjust the driving signal so that the two actuator columns have the same level of ink discharging performance.

Note that both the size of the pressure chamber and the size of the actuator are varied between two columns in the embodiment described above. Alternatively, only one of the size of the pressure chamber and the size of the actuator may be varied between two columns. Also in such a case, it is easy to adjust the driving signal so that the two actuator columns have the same level of ink discharging performance.

EMBODIMENT 7

Embodiment 7 is similar to Embodiment 1 except that the driving signal is modified. As illustrated in FIG. 18A to FIG. 18D, the driving signal of Embodiment 7 includes an ink discharging pulse signal P1 that causes ink to be discharged and an auxiliary pulse signal P2 that does not cause ink to be discharged.

The auxiliary pulse signal P2 is a signal that deforms an actuator to such a degree that ink is not discharged, and is used for reducing the meniscus vibration in the nozzle after ink is discharged therethrough, for preventing the viscosity of ink in the nozzle from increasing, etc. The ink discharging pulse signal P1 is applied only in particular ones of a plurality of cycles in which ink is to be discharged, whereas the auxiliary pulse signal P2 is a signal that is applied in every cycle regardless of whether ink is to be discharged.

With the driving signal illustrated in FIG. 18A to FIG. 18D, for example, where the scanning signal is applied to the actuators of the first column in the first cycle and the third cycle, the ink discharging pulse signal P1 and the auxiliary pulse signal P2 are applied in the first cycle in which ink is to be discharged, whereas only the auxiliary pulse signal P2 is applied in the third cycle in which ink is not to be discharged.

In order to produce such a driving signal, the recording signal may include the ink discharging pulse signal P1 and the auxiliary pulse signal P2 while the scanning signal is at a constant potential, as illustrated in FIG. 18A to FIG. 18D.

Alternatively, the voltage of the ink discharging pulse signal P1 may be varied between actuator columns, as illustrated in FIG. 19A to FIG. 19D.

Alternatively, the ink discharging pulse signal P1 may be included in the recording signal while the auxiliary pulse signal P2 is included in the scanning signal, as illustrated in FIG. 20A to FIG. 20E. A predetermined driving signal can be obtained by superimposing such a recording signal and such a scanning signal on each other. Note that the auxiliary pulse signal P2 may be supplied to the actuators of the first column while the auxiliary pulse signal P2 is not supplied to the actuators of the second column.

Also in such a case, the voltage of the ink discharging pulse signal P1 may be varied between actuator columns, as illustrated in FIG. 21A to FIG. 21E.

Alternatively, the potential of the auxiliary pulse signal P2 of the driving signal may be varied between actuator columns, as illustrated in FIG. 22A to FIG. 22D. By setting the potential of the auxiliary pulse signal P2 for each column as described above, it is possible to vary the amount of actuator deformation for each column according to the actuator characteristics or the ink characteristics of the column. For example, it is possible to freely set how much an ink is stirred according to the viscosity of the ink by, for example, setting the potential of the auxiliary pulse signal P2 to be high for a column of a high ink viscosity while setting the potential of the auxiliary pulse signal P2 to be low for a column of a low ink viscosity.

Figure 23A:
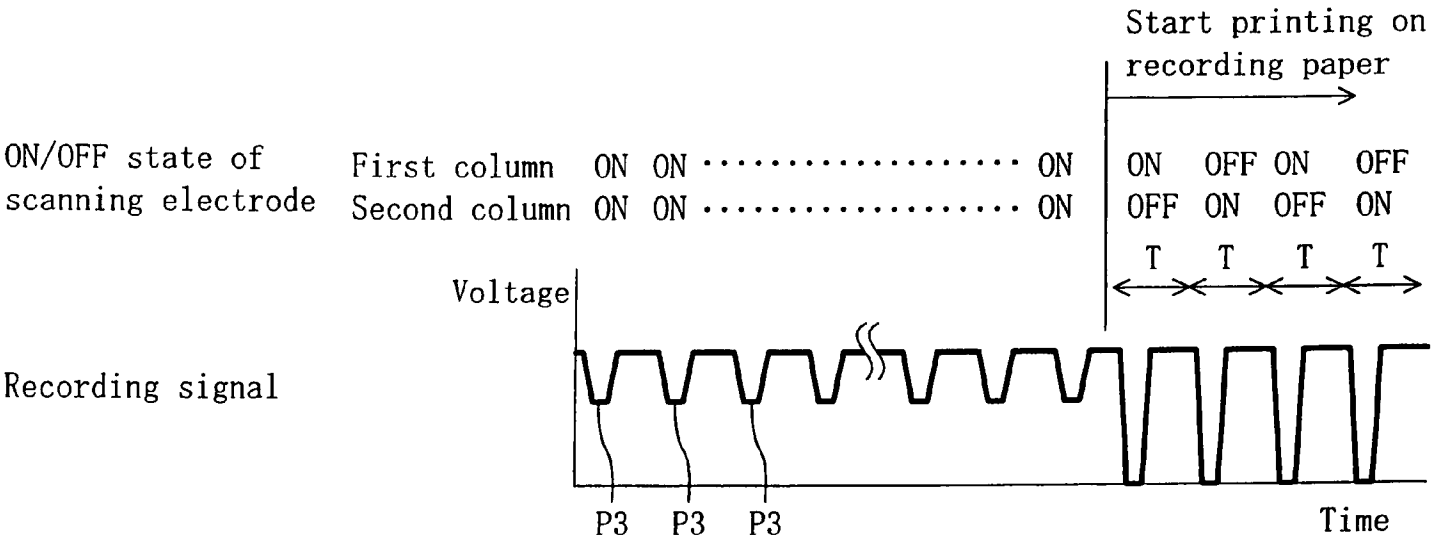

Typically, at the time when starting an ink discharging operation, ink in a nozzle may be dry, whereby a false discharge of ink is likely to occur through the nozzle. In view of this, a preliminary vibration pulse signal P3 may be applied to all actuators before the ink jet head starts an ink discharging operation, as illustrated in FIG. 23A and FIG. 23B. In this way, preliminary stirring of ink is performed for each nozzle, thereby preventing the viscosity of ink in the nozzle from increasing. Thus, it is possible to prevent a false discharge of ink.

EMBODIMENT 8

The ink jet head according to Embodiment 8 is an ink jet head for performing a so-called "multi-gray-level" recording operation, and is capable of selectively discharging a small ink droplet and a large ink droplet.

Figures 24A, 24B:
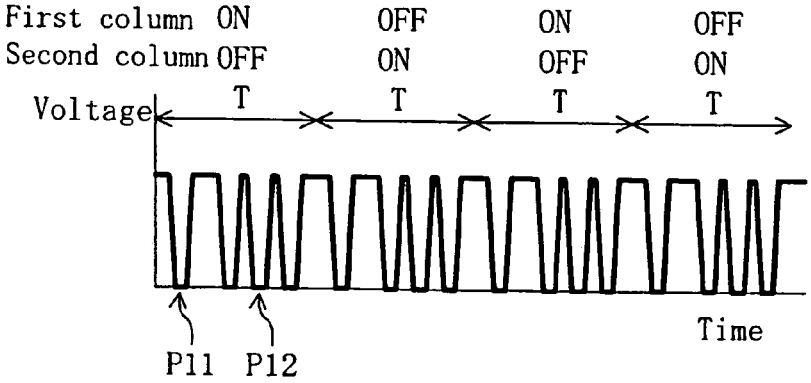
FIG. 24A and FIG. 24B are waveform diagrams illustrating signals used in Embodiment 8.

As illustrated in FIG. 24A and FIG. 24B, the recording signal includes a first pulse signal P11 including a single pulse and a pulse signal P12 including a plurality of pulses. The pulse signal P12 is applied after the first pulse signal P11. Although not shown in the figures, in the present embodiment, a small ink droplet is discharged when only the first pulse signal P11 is applied, and a large ink droplet is discharged when only the pulse signal P12 is applied.

After a large ink droplet is discharged, the magnitude of the residual vibration of ink meniscus is relatively high. Therefore, in the prior art, when a small ink droplet is discharged after discharging a large ink droplet, the ink discharging performance may become unstable due to the influence of the residual vibration.

However, in the present embodiment, the scanning signal is applied to two actuator columns in an alternating manner, whereby the driving signal is applied to the actuators of each column every other cycle. Therefore, when a large ink droplet is discharged from an actuator in one cycle (e.g., the first cycle), the actuator is not driven in the following cycle (the second cycle), whereby even if a small ink droplet is discharged in the next cycle (the third cycle), the influence of the residual vibration is suppressed sufficiently by the time when the small ink droplet is discharged in the next cycle. Therefore, it is possible to suppress the adverse influence of the residual vibration without reducing the driving frequency.

EMBODIMENT 9

In the embodiments described above, actuators adjacent to each other in the horizontal direction are aligned with each other with respect to the vertical direction. Alternatively, actuators adjacent to each other in the horizontal direction may be shifted from each other with respect to the vertical direction.

Figure 25:
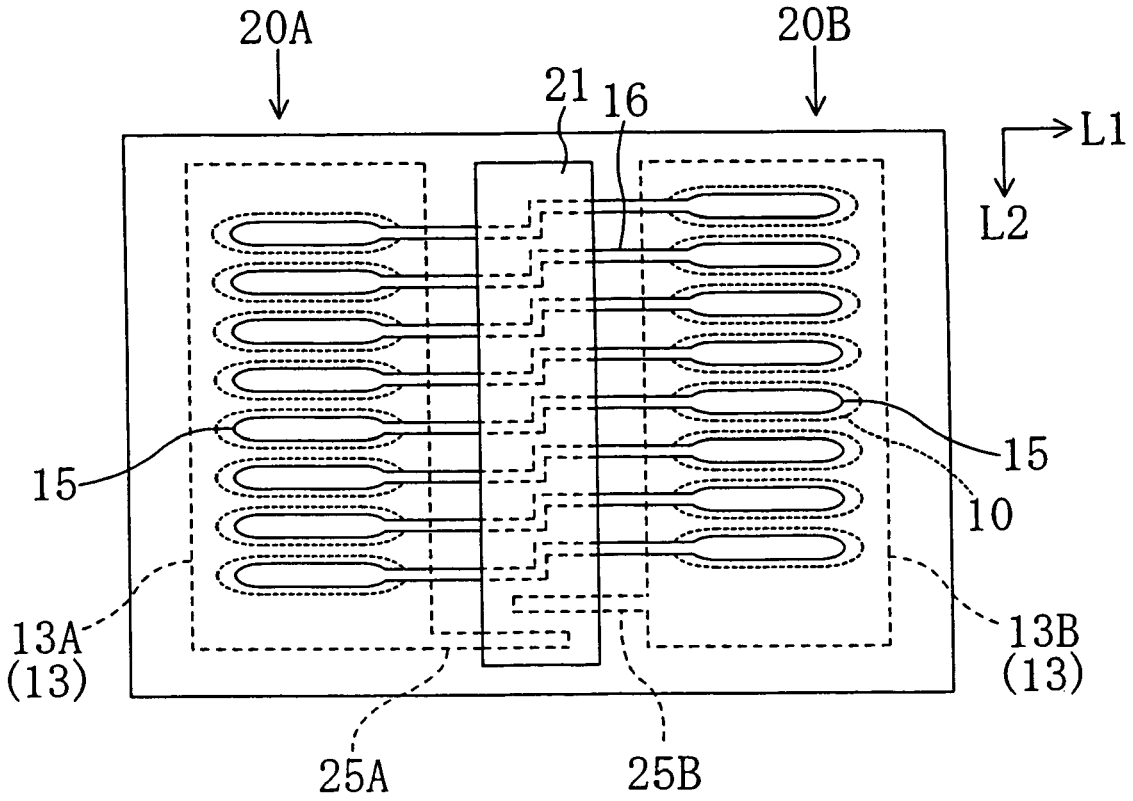
FIG. 25 is a plan view illustrating an ink jet head according to Embodiment 9.

For example, the actuators of the first actuator column 20A and the actuators of the second actuator column 20B may be shifted from each other by half a pitch with respect to the vertical direction, as illustrated in FIG. 25. Then, the actuators are arranged in a staggered pattern.

The driving signal supplied to the first actuator column 20A and the second actuator column 20B may be a driving signal as described in Embodiment 1 or a driving signal as described in Embodiment 5.

Alternatively, actuators may be arranged in a staggered pattern in three or more actuator columns.

Alternatively, with n rows by m columns of actuators, the m vertical actuator columns (each including n actuators) may be arranged so that actuators of adjacent vertical actuator columns are shifted from each other by 1/m a pitch.

Thus, in the ink jet head of the present invention, the arrangement of n rows by m columns of actuators may be modified as necessary.

Alternative Embodiments

The present invention is not limited to Embodiments 1 to 9 set forth above, but may be carried out in various other ways without departing from the spirit or main features thereof.

Thus, the embodiments set forth above are merely illustrative in every respect, and should not be taken as limiting. The scope of the present invention is defined by the appended claims, and in no way is limited to the description set forth herein. Moreover, any variations and/or modifications that are equivalent in scope to the claims fall within the scope of the present invention.

What is claimed is:

1. An ink jet head, comprising:

a head assembly provided with a plurality of nozzles and a plurality of pressure chambers storing ink therein and communicated respectively to the nozzles;

actuators each associated with one of the pressure chambers and each including a piezoelectric element, a scanning electrode provided on one side of the piezoelectric element, and a recording electrode provided on the other side of the piezoelectric element, wherein the actuators are arranged in a matrix pattern of n rows by m columns (where n and m are natural numbers equal to or greater than two) in terms of electrical circuit, with recording electrodes of each row being electrically connected to one another, and scanning electrodes of each column being electrically connected to one another; and a driving circuit for supplying a scanning signal to the scanning electrodes for each column, while supplying a recording signal to each row of the recording electrodes in synchronization with the scanning signal, wherein a voltage of a driving signal obtained by combining the scanning signal with the recording signal varies among at least two or more actuator columns, wherein when ink is to be discharged, the driving signal includes an ink discharging pulse signal for driving an actuator so as to discharge ink and an auxiliary pulse signal for driving an actuator to such a degree that ink is not discharged, and when ink is not to be discharged, the driving signal includes the auxiliary pulse signal for driving an actuator to such a degree that ink is not discharged; and a voltage of the ink discharging pulse signal varies among at least two or more actuator columns.

2. The ink jet head of claim 1, wherein:

the ink discharging pulse signal is included in the recording signal; and the auxiliary pulse signal is included in the scanning signal.

3. The ink jet head of claim 1, wherein when a small ink droplet is to be discharged, the ink discharging pulse signal includes a first pulse signal, and when a large ink droplet is to be discharged, the ink discharging pulse signal includes two or more following pulse signals produced after the first pulse signal.

4. An ink jet head, comprising:

a head assembly provided with a plurality of nozzles and a plurality of pressure chambers storing ink therein and communicated respectively to the nozzles;

actuators each associated with one of the pressure chambers and each including a piezoelectric element, a scanning electrode provided on one side of the piezoelectric element, and a recording electrode provided on the other side of the piezoelectric element, wherein the actuators are arranged in a matrix pattern of n rows by m columns (where n and m are natural numbers equal to or greater than two) in terms of electrical circuit, with recording electrodes of each row being electrically connected to one another, and scanning electrodes of each column being electrically connected to one another; and a driving circuit for supplying a scanning signal to the scanning electrodes for each column, while supplying a recording signal to each row of the recording electrodes in synchronization with the scanning signal, wherein a voltage of a driving signal obtained by combining the scanning signal with the recording signal varies among at least two or more actuator columns, wherein when ink is to be discharged, the driving signal includes an ink discharging pulse signal for driving an actuator so as to discharge ink and an auxiliary pulse signal for driving an actuator to such a degree that ink is not discharged, and when ink is not to be discharged, the driving signal includes the auxiliary pulse signal for driving an actuator to such a degree that ink is not discharged; and a voltage of the auxiliary pulse signal varies among at least two or more actuator columns.

5. The ink jet head of claim 4, wherein:

the ink discharging pulse signal is included in the recording signal; and the auxiliary pulse signal is included in the scanning signal.

6. The ink jet head of claim 4, wherein when a small ink droplet is to be discharged, the ink discharging pulse signal includes a first pulse signal, and when a large ink droplet is to be discharged, the ink discharging pulse signal includes two or more following pulse signals produced after the first pulse signal.

7. An ink jet recording apparatus, comprising:

a head assembly provided with a plurality of nozzles and a plurality of pressure chambers storing ink therein and communicated respectively to the nozzles;

actuators each associated with one of the pressure chambers and each including a piezoelectric element, a scanning electrode provided on one side of the piezoelectric element, and a recording electrode provided on the other side of the piezoelectric element, wherein the actuators are arranged in a matrix pattern of n rows by m columns (where n and m are natural numbers equal to or greater than two) in terms of electrical circuit, with recording electrodes of each row being electrically connected to one another, and scanning electrodes of each column being electrically connected to one another: and a driving circuit for supplying a scanning signal to the scanning electrodes for each column, while supplying a recording signal to each row of the recording electrodes in synchronization with the scanning signal, wherein a voltage of a driving signal obtained by combining the scanning signal with the recording signal varies among at least two or more actuator columns, wherein when ink is to be discharged, the driving signal includes an ink discharging pulse signal for driving an actuator so as to discharge ink and an auxiliary pulse signal for driving an actuator to such a degree that ink is not discharged, and when ink is not to be discharged, the driving signal includes the auxiliary pulse signal for driving an actuator to such a degree that ink is not discharged;

a voltage of the ink discharging pulse signal varies among at least two or more actuator columns; and movement means for relatively moving the ink jet head and a recording medium with respect to each other.

8. An ink jet recording apparatus, comprising:

a head assembly provided with a plurality of nozzles and a plurality of pressure chambers storing ink therein and communicated respectively to the nozzles;

actuators each associated with one of the pressure chambers and each including a piezoelectric element, a scanning electrode provided on one side of the piezoelectric element, and a recording electrode provided on the other side of the piezoelectric element, wherein the actuators are arranged in a matrix pattern of n rows by m columns (where n and m are natural numbers equal to or greater than two) in terms of electrical circuit, with recording electrodes of each row being electrically connected to one another, and scanning electrodes of each column being electrically connected to one another; and a driving circuit for supplying a scanning signal to the scanning electrodes for each column, while supplying a recording signal to each row of the recording electrodes in synchronization with the scanning signal, wherein a voltage of a driving signal obtained by combining the scanning signal with the recording signal varies among at least two or more actuator columns, wherein when ink is to be discharged, the driving signal includes an ink discharging pulse signal for driving an actuator so as to discharge ink and an auxiliary pulse signal for driving an actuator to such a degree that ink is not discharged, and when ink is not to be discharged, the driving signal includes the auxiliary pulse signal for driving an actuator to such a degree that ink is not discharged;

a voltage of the auxiliary pulse signal varies among at least two or more actuator columns; and movement means for relatively moving the ink jet head and a recording medium with respect to each other.

* * * * *